US012116163B2

(12) United States Patent
Turner

(10) Patent No.: US 12,116,163 B2
(45) **Date of Patent: *Oct. 15, 2024**

(54) SHIPPING CONTAINERS WITH INTERCHANGEABLE FEET

(71) Applicant: MACRO PLASTICS, INC., Fairfield, CA (US)

(72) Inventor: Todd T. Turner, Corydon, IN (US)

(73) Assignee: MACRO PLASTICS, INO., Fairfield, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/206,687

(22) Filed: Jun. 7, 2023

(65) Prior Publication Data

US 2023/0312170 A1 Oct. 5, 2023

Related U.S. Application Data

(62) Division of application No. 17/318,402, filed on May 12, 2021, now Pat. No. 11,673,709.

(60) Provisional application No. 63/024,067, filed on May 13, 2020.

(51) Int. Cl.
*B65D 19/40* (2006.01)
*B65D 19/06* (2006.01)

(52) U.S. Cl.
CPC ..... *B65D 19/40* (2013.01); *B65D 19/06* (2013.01); *B65D 2519/00273* (2013.01); *B65D 2519/00338* (2013.01); *B65D 2519/00567* (2013.01); *B65D 2519/00676* (2013.01)

(58) Field of Classification Search
CPC ..... B65D 19/40; B65D 19/06; B65D 2519/00273; B65D 2519/00338; B65D 2519/00567; B65D 2519/00676; B65D 19/385
USPC ..... 206/386, 600, 599; 248/346.02, 346.01, 248/677, 688, 678
See application file for complete search history.

(56) References Cited

U.S. PATENT DOCUMENTS

| | | | |
|---|---|---|---|
| 4,887,731 | A | 12/1989 | Pett et al. |
| 5,918,800 | A | 7/1999 | Goshorn et al. |
| 6,357,366 | B1 | 3/2002 | Frankenberg |
| 7,607,542 | B1 | 10/2009 | Hsieh |
| D672,960 | S | 12/2012 | Turner |

(Continued)

FOREIGN PATENT DOCUMENTS

| | | | |
|---|---|---|---|
| CL | 48578 | B1 | 3/1999 |
| DE | 3200741 | A1 | 8/1982 |

(Continued)

OTHER PUBLICATIONS (IPL) Macro, Macro Plastics, Inc.; Hybrid 1012; product guide; pp. 1-6; accessed from website Jun. 29, 2021; https://www .macroplastics.com/product/hybrid-1012/.

(Continued)

*Primary Examiner* — Rafael A Ortiz
(74) *Attorney, Agent, or Firm* — Wyatt, Tarrant & Combs, LLP; Max E. Bridges; Matthew A. Williams

(57) ABSTRACT

A shipping container comprising a basket, a plurality of feet, and a plurality of removable corner columns. In some embodiments, the shipping container comprises a basket, a plurality of feet, and a plurality of foot pads. Further embodiments include foot pads with drill release locks.

20 Claims, 31 Drawing Sheets

(56) References Cited

U.S. PATENT DOCUMENTS

| | | | | |
|---|---|---|---|---|
| 8,434,618 | B2 * | 5/2013 | Mitchell | B65D 19/06 206/386 |
| 8,950,612 | B2 | 2/2015 | Turner | |
| 2009/0084783 | A1 | 4/2009 | Apps | |
| 2009/0127158 | A1 * | 5/2009 | Apps | B65D 19/06 206/600 |
| 2011/0089299 | A1 * | 4/2011 | Gong | G06F 1/1656 248/346.01 |
| 2013/0313270 | A1 | 11/2013 | Winterberg | |
| 2015/0108037 | A1 * | 4/2015 | Evans | B65D 19/18 108/50.11 |
| 2016/0012926 | A1 | 1/2016 | Lehnert et al. | |
| 2016/0288951 | A1 | 10/2016 | Rader et al. | |
| 2019/0203459 | A1 | 7/2019 | Fogg et al. | |
| 2021/0284411 | A1 * | 9/2021 | Fukuda | B65D 19/0012 |

FOREIGN PATENT DOCUMENTS

| | | | | |
|---|---|---|---|---|
| DE | 19802307 | C2 | 2/2000 | |
| DE | 102004059527 | A1 * | 6/2006 | B65D 19/18 |
| DE | 102008004109 | A1 * | 7/2009 | B65D 19/0028 |
| DE | 102008023565 | A1 * | 11/2009 | B65D 19/0028 |
| DE | 102014002832 | A1 * | 8/2015 | B65D 19/0016 |
| EP | 1535858 | A1 * | 6/2005 | B65D 19/10 |
| GB | 2156313 | A | 10/1985 | |
| GB | 2477328 | A | 8/2011 | |
| WO | WO2012085941 | A1 | 6/2012 | |
| WO | WO2012088297 | A1 | 6/2012 | |

OTHER PUBLICATIONS (IPL) Macro, Macro Plastics; Macroplastics Assembly and Disassembly of the Hybrid 1012; YouTube video; https://www.youtube.com/watch?v=VD67X-pbj3w&feature=emb _ title.

The United States Patent and Trademark Office; The International Search Report and the Written Opinion of the international Searching Authority, or the Declaration of PCT/US21/31951; Oct. 15, 2021; pp. 1-13; The United States Patent and Trademark Office (as Searching Authority): US.

* cited by examiner

SHIPPING CONTAINERS WITH INTERCHANGEABLE FEET

CROSS-REFERENCE TO RELATED APPLICATIONS

This divisional patent application is filed under 35 U.S.C. Section 121 and claims the benefit of and priority to U.S. Nonprovisional patent application Ser. No. 17/318,402, filed on May 12, 2021, which claims the benefit of and priority to U.S. Provisional Patent Application Ser. No. 63/024,067, with a filing date of May 13, 2020, the contents of all of which are fully incorporated herein by reference.

FIELD OF INVENTION

The embodiments described herein relate to shipping containers made of multiple components (including interchangeable feet) that can be easily assembled, disassembled, and replaced.

BACKGROUND

For many years, industries dealing in bulk goods have utilized returnable shipping containers. The use of the conventional shipping container, however, presents a number of disadvantages to the transportation, shipping, agricultural, retail, and handling industry. In particular, the conventional shipping container often comprises a single piece of plastic (as a non-limiting example) consisting of a basket and bottom components (referred to herein as "feet") which are positioned underneath the basket to contact the floor or ground. During transportation and use, the feet are often damaged and need to be repaired. However, rather than replacing the one damaged component, the entire shipping container has to be replaced because it comprises a single piece. As such, the typical conventional shipping container is difficult to assemble, disassemble, and repair.

Accordingly, there is a significant need for a shipping container that can be rapidly assembled, disassembled, and easily repaired. Such a shipping container would provide industries dealing in bulk goods with the ability to easily replace a single damaged component without replacing the entire container. Along with other features and advantages outlined herein, the shipping containers within the scope of present embodiments meet these and other needs.

SUMMARY OF EMBODIMENTS

A shipping container with removable feet, referred to herein as a "shipping container" for brevity, according to multiple embodiments and alternatives, comprises a variety of components that can be easily interconnected and repaired. In some embodiments, the shipping container comprises a basket, a pair of feet, and corner columns, all of which are removable and interconnected by a variety of connections including but not limited to locking buttons, press release buttons, and pull clips (explained in more detail below). According to multiple embodiments and alternatives, the corner columns secure to the basket by a single release button and, at the same time, secure the pair of feet to the bottom surface of the basket. To remove the feet or the corner columns, a user can simply press the single release button on the corner columns. As such, the interconnectivity of the components permits rapid assembly, disassembly, and easy repair of the shipping container.

Likewise, the corner columns protect the containers by absorbing and recoiling impact rather than resisting the blow and breaking. In some embodiments, when the feet and removable columns are removed, the baskets nest into each other for economical shipping and storage when empty. The feet and removable columns can also be locked into place or removed for returnable shipping and storage. Accordingly, the shipping containers described herein provide improved shipping efficiencies over conventional containers.

In some embodiments, the corner columns are not removable and the shipping container comprises a basket, a pair of feet, and a plurality of foot pads, all of which are easily interconnected to one another. According to multiple embodiments and alternatives, the pair of feet pads secure to the bottom corners of the basket by a single release button and, at the same time, secure the pair of feet to the bottom surface of the basket.

In conventional shipping containers, the components are often connected by tabs that have to be drilled out and then chipped away for assembly. This conventional approach is, however, time consuming and difficult. The current embodiments address this problem by providing for a drill release lock comprising a pilot hole such that a drill (as a non-limiting example) can split a back support rib. These embodiments are superior to conventional drill tabs by permitting the drill release lock to easily and efficiently hinge, thereby providing a more secure connection between the components.

It will be appreciated by one of ordinary skill in the art that any number of component interconnections may be selected as needed by a user. As non-limiting examples, a user may desire to utilize the shipping container for harvesting agricultural products in a long growing season. Accordingly, the user can select the more permanent connections consisting of locked buttons and press release buttons. If a user desires to disassemble the shipping container in the winter, the user may select interconnections comprising press release buttons and pull clips that can be more easily disassembled. Likewise, a user may wish to easily transport the container for returnable shipping and storage. As such, a user may select a shipping container with removable columns and feet interconnected by locked buttons, press release buttons, and pull clips.

Accordingly, the shipping containers in current embodiments can be rapidly assembled, disassembled, and repaired, thereby providing a key advantage over conventional shipping containers. Along with other features disclosed herein, the versatility and ease of operation of the shipping containers provide a number of advantages over conventional shipping containers.

BRIEF DESCRIPTION OF THE FIGURES

The drawings and embodiments described herein are illustrative of multiple alternative structures, aspects, and features of the present embodiments, and they are not to be understood as limiting the scope of present embodiments. It will be further understood that the drawing Figures described and provided herein are not to scale, and that the embodiments are not limited to the precise arrangements and instrumentalities shown.

MULTIPLE EMBODIMENTS AND ALTERNATIVES

Figure 1:
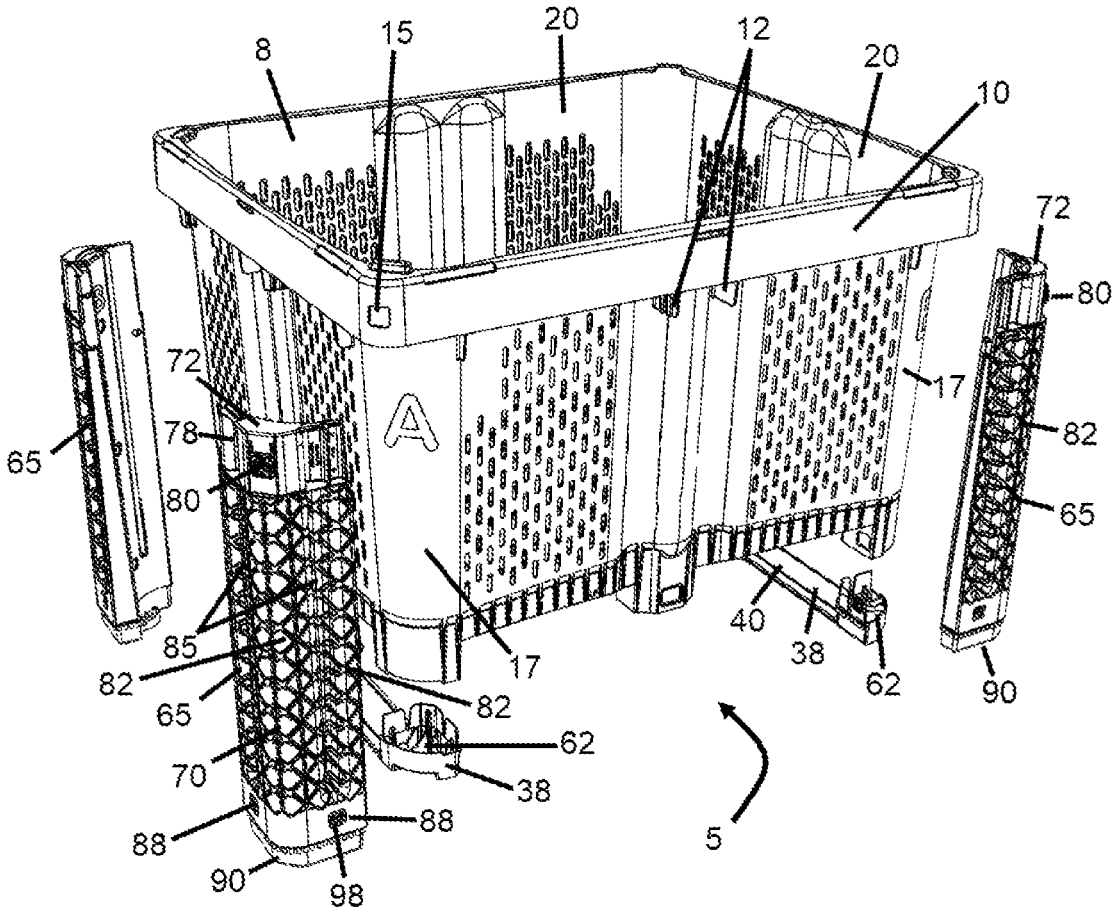
FIG. 1 is a top, exploded, and perspective view of a shipping container comprising a basket, a pair of feet, and corner columns, according to multiple embodiments and alternatives.
Figure 2:
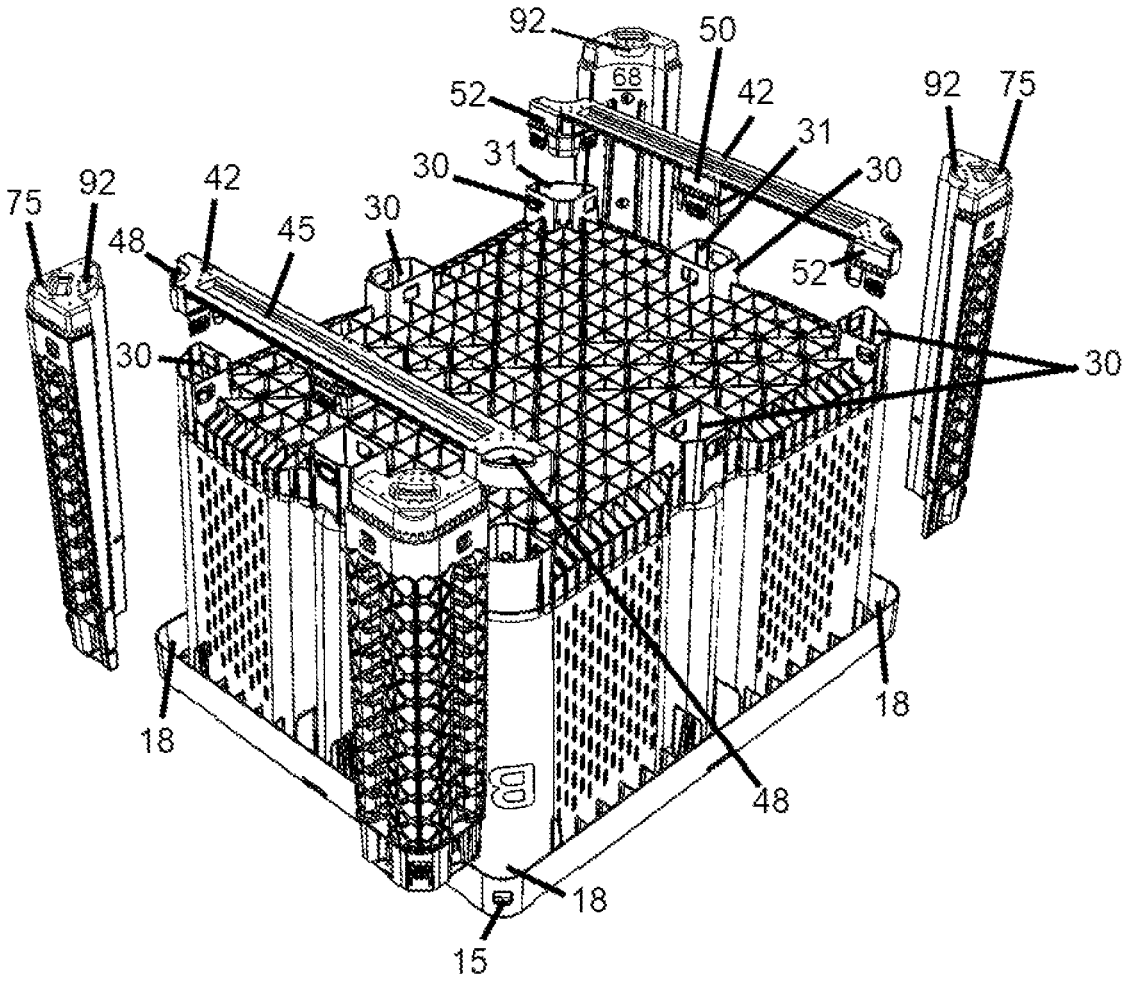
FIG. 2 is a bottom, exploded, and perspective view of a shipping container comprising a basket, a pair of feet, and corner columns, according to multiple embodiments and alternatives.
Figure 3:
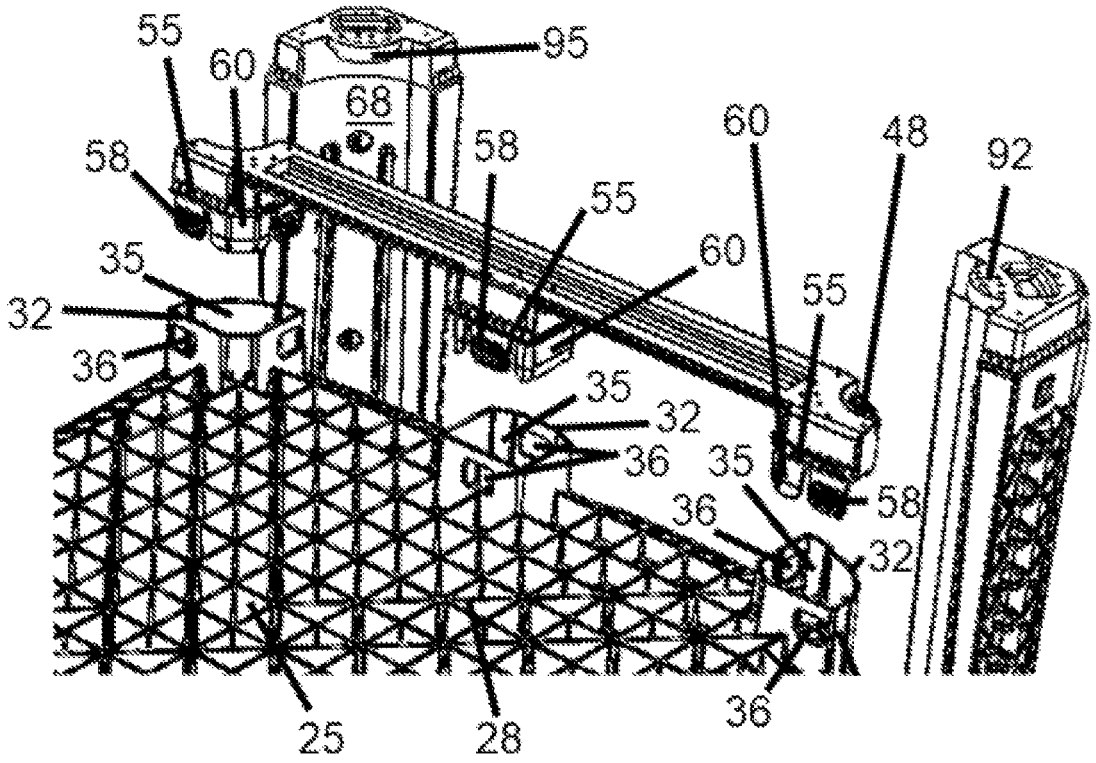
FIG. 3 is a close up view of the bottom of a basket, a foot, and corner columns, according to multiple embodiments and alternatives.

FIGS. 1-3 show exploded views of shipping container 5, according to multiple embodiments and alternatives. Shipping container 5 consists of a basket 8, a plurality of corner columns 65, and feet 38 (also referred to herein as a plurality of feet). As shown in FIG. 1, basket 8 comprises top rim 10, support members 12 (which are positioned between the side walls 20 and the top rim 10), and corners 17 (also referred to as a plurality of corner faces which are defined by the pair of opposing sides of the basket 8). As shown most clearly in FIG. 2, the top rim 10 defines a plurality of slots 18 which are adapted to receive the top member 78 of the corner columns 65. The top rim 10 also defines a plurality of button receiving holes 15, located adjacent to the corners 17, which are adapted to receive the release button 80 of the corner columns 65.

As shown in FIGS. 2-3, the basket 8 includes a bottom surface 25 comprising a series of reinforcing cells 28 and a plurality of extensions 30 which extend downward. Each of the extensions 30 consist of sidewalls 31 which define foot receiving bores 35 (also referred to as apertures herein) that are adapted to receive the middle component 50 and end components 52, respectively, of the feet 38. The sidewalls 31 of the extensions 30 also define a bottom edge 32 and a plurality of pull clip openings 36 that are adapted to receive the pull clips 58 of the feet 38.

The corner columns 65 each consist of a top member 78, a middle member 82, a bottom member 90, a top surface 72, a bottom surface 75, an internal side 68, and an external side 70. The internal side 68 is adapted to mate with the corners 17 of the basket 8, and the top member 78 is adapted to mate with the plurality of slots 18 of basket 8. In some embodiments, the top member 78 is permanently connected to the middle member 82, and includes a release button 80 positioned on the external side 70. The release button 80 is hingeably connected to external side 70 of the top member 78 such that a user can push the release button 80 inward within the top member 78. The release button 80 is adapted to mate and connect with the button receiving hole 15 of basket 8.

The middle member 82 of the corner columns 65 includes grooves 85 which span its length and provide support. The middle member 82 also defines button receiving hole 88 which is adapted to receive the locked button 98 of the bottom member 90. The middle member 82 also defines an opening at its bottom end (not shown in the figures) that receives the bottom member 90. In some embodiments, the bottom member 90 is received within the bottom of the middle member 82 and includes locked button 98. When locked button 98 is received within the button receiving hole 88, the bottom member 90 is fixably attached to the middle member 82. As shown in FIGS. 2 and 3, the bottom member 90 also includes lip 92 and a protrusion 95 which extends upward from lip 92. Lip 92 and protrusion 95 are adapted to connect and secure to the notch 48 of the feet 38.

The feet 38 each consist of a top surface 40, a bottom surface 42, a middle component 50, and end components 52. The bottom surface 42 includes a groove 45 which spans the bottom length of the feet 38 and provides support. The ends of the bottom surface 42 also comprise a notch 48 which is adapted to receive the lip 92 and protrusion 95 of the corner columns 65. The middle component 50 and end components 52 each include support ribs 62 (best shown in FIG. 1). According to multiple embodiments and alternatives, the middle component 50 and end components 52 each include a shoulder 55 which is larger than the plurality of foot receiving bores 35 and is adapted to engage the bottom edge 32 of the extensions 30. The middle component 50 and the end components 52 further include a plurality of tabs 60 which extend upward from, and are hingeably connected to, shoulder 55. The plurality of tabs 60 are adapted to flexibly engage the sidewalls 31 of extensions 30 upon entry of the components 50, 52 into the plurality of foot receiving bores 35. In some embodiments, the outer surface of the tabs 60 further includes pull clips 58 which are adapted to connect with the pull clip openings 36. Upon entry of the components 50, 52 into the plurality of foot receiving bores 35, the tabs 60 flex inward and engage the sidewalls 31, and the pull clips 58 engage and secure to the pull clip openings 36.

Figure 4:
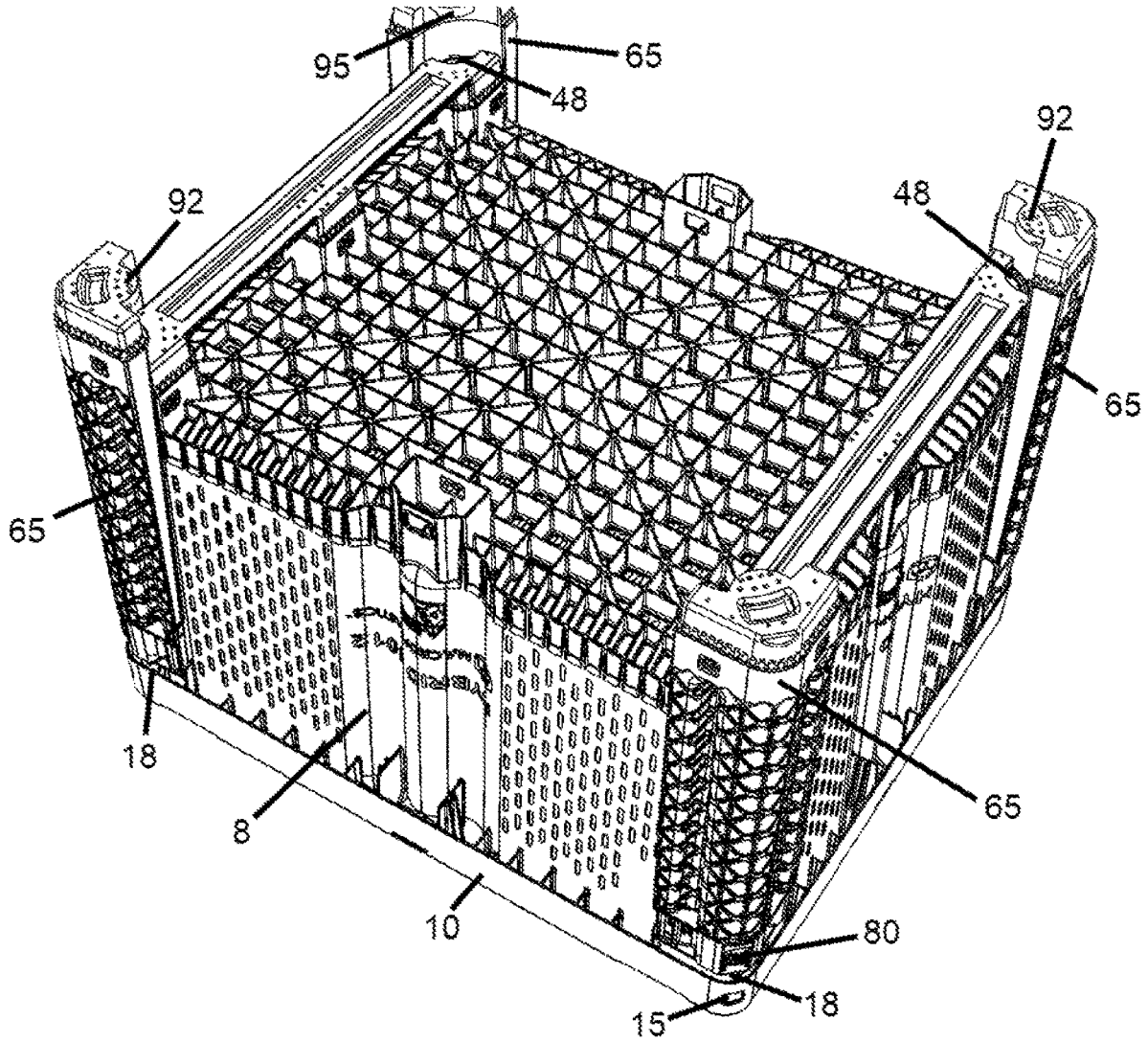
FIG. 4 is a bottom, perspective view of a shipping container comprising a basket, a pair of feet, and corner columns, according to multiple embodiments and alternatives.

FIG. 4 illustrates a step in the assembly of shipping container 5, according to multiple embodiments and alternatives. In operation, to assemble shipping container 5, a user first places the basket 8 upside down such that the bottom surface 25 is facing upwards (as shown in FIG. 4). Next, a user securely attaches the feet 38 into the bottom surface 25 of the basket 8 by aligning the components 50, 52 with the plurality of foot receiving bores 35. The user then inserts the components 50, 52 into the plurality of foot receiving bores 35 until the shoulders 55 engage the bottom edge 32 of the extensions 30 and the pull clips 58 are secured within the pull clip openings 36. As shown in FIG. 4, the user then attaches the corner columns 65. In some embodiments, the corners 17 of basket 8 and the internal side 68 of the corner columns 65 contain corresponding markings to guide the user on where to attach the corner columns 65. For example, FIGS. 1 and 2 illustrate corresponding "A" and "B" markings. To attach the corner columns 65, the user inserts the top member 78 into the slot 18 of the basket 8 until the release button 80 is securely attached to the button receiving hole 15 and the protrusion 95 of the bottom member 90 engages the notch 48 of the feet 38.

Figure 5:
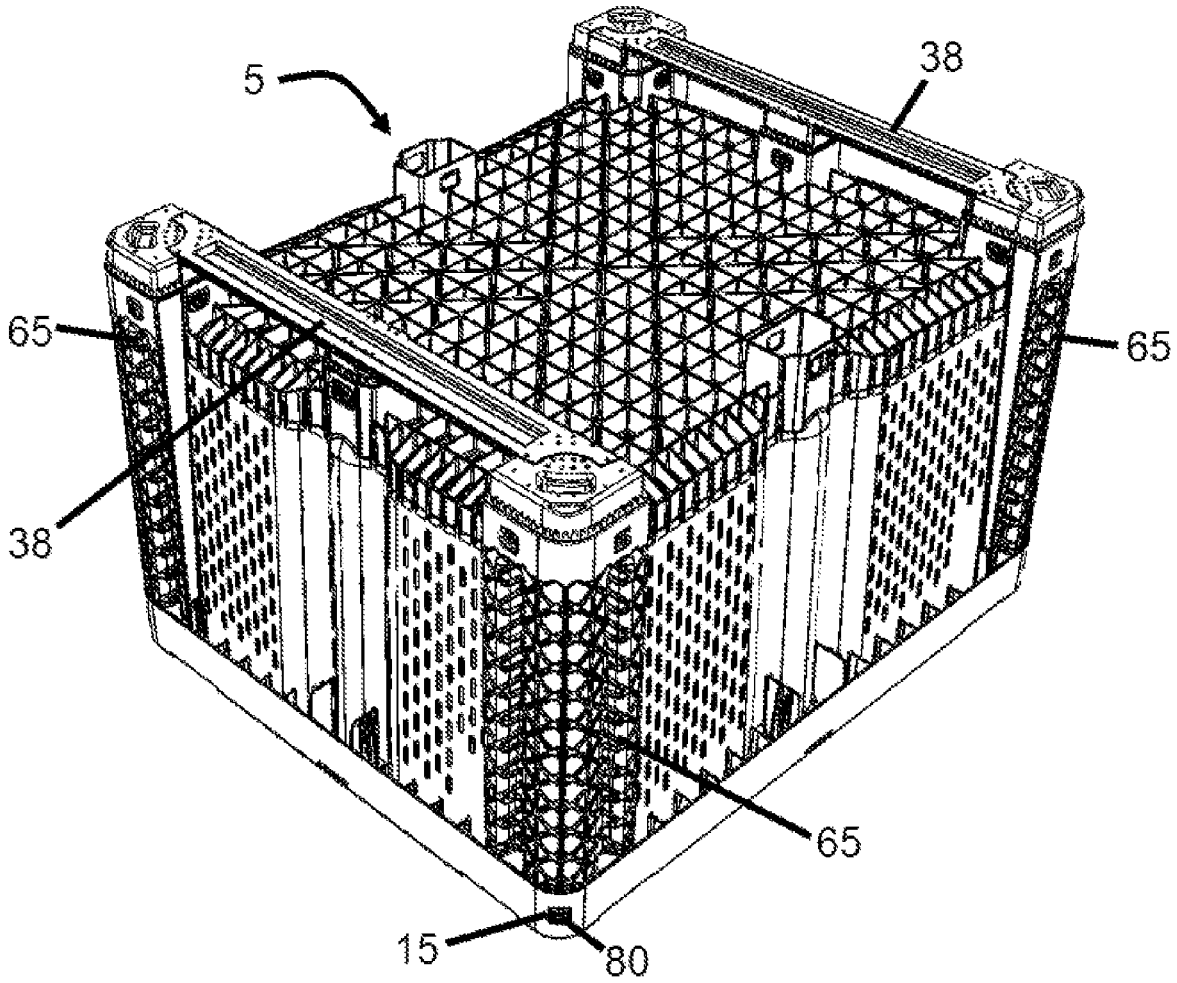
FIG. 5 is a bottom, perspective view of an assembled shipping container, according to multiple embodiments and alternatives.
Figure 6:
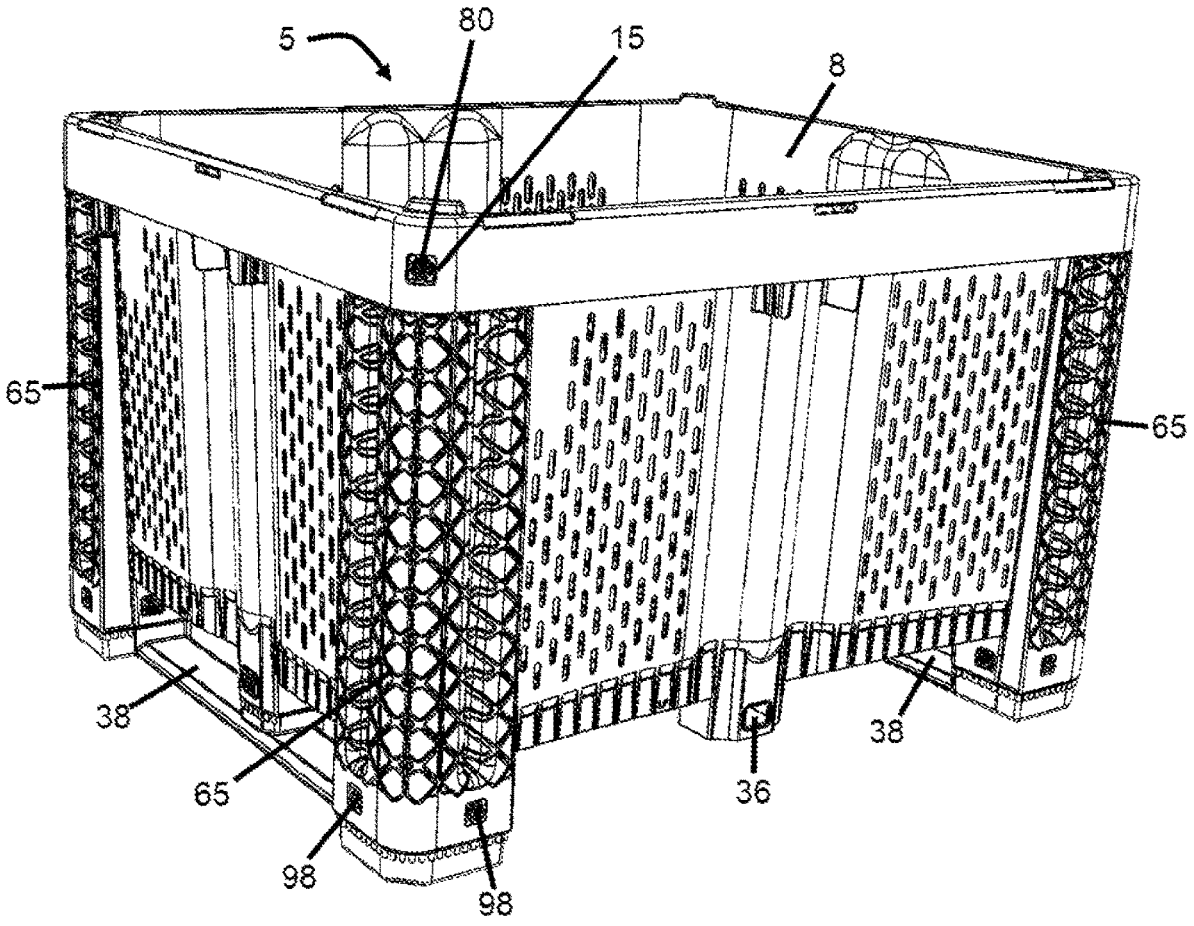
FIG. 6 is a top, perspective view of an assembled shipping container, according to multiple embodiments and alternatives.

FIGS. 5 and 6 illustrate assembled shipping container 5. According to multiple embodiments and alternatives, the release button 80 and the engagement between the protrusion 95 and the notch 48 securely attaches both the feet 38 and the corner columns 65 to the basket 8. To disassemble the shipping container 5, a user can simply press the release button 80 inwardly and pull the corner columns 65 from the slots 18. To remove the feet 38, the user simply pulls the feet 38 out of the plurality of feet receiving bores 35 (e.g. by pulling upward on the feet 38 shown in FIG. 5). When a pulling force is applied to the tabs 60 and pull clips 58, the tabs 60 pivot inward and permit the user to remove the feet 38 from the bottom surface of the basket 8.

Figure 7:
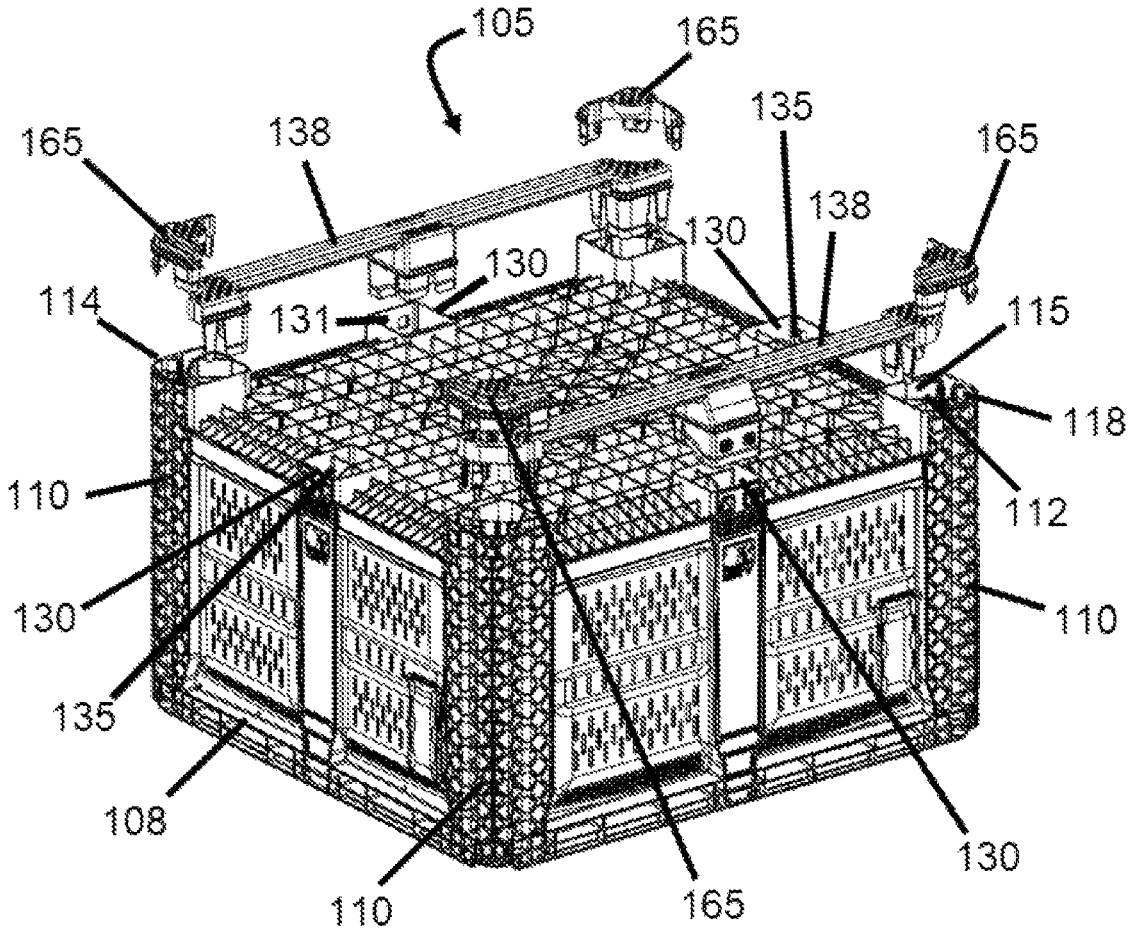
FIG. 7 is a bottom, exploded, and perspective view of a shipping container comprising a basket, a pair of feet, and feet pads, according to multiple embodiments and alternatives.
Figure 8:
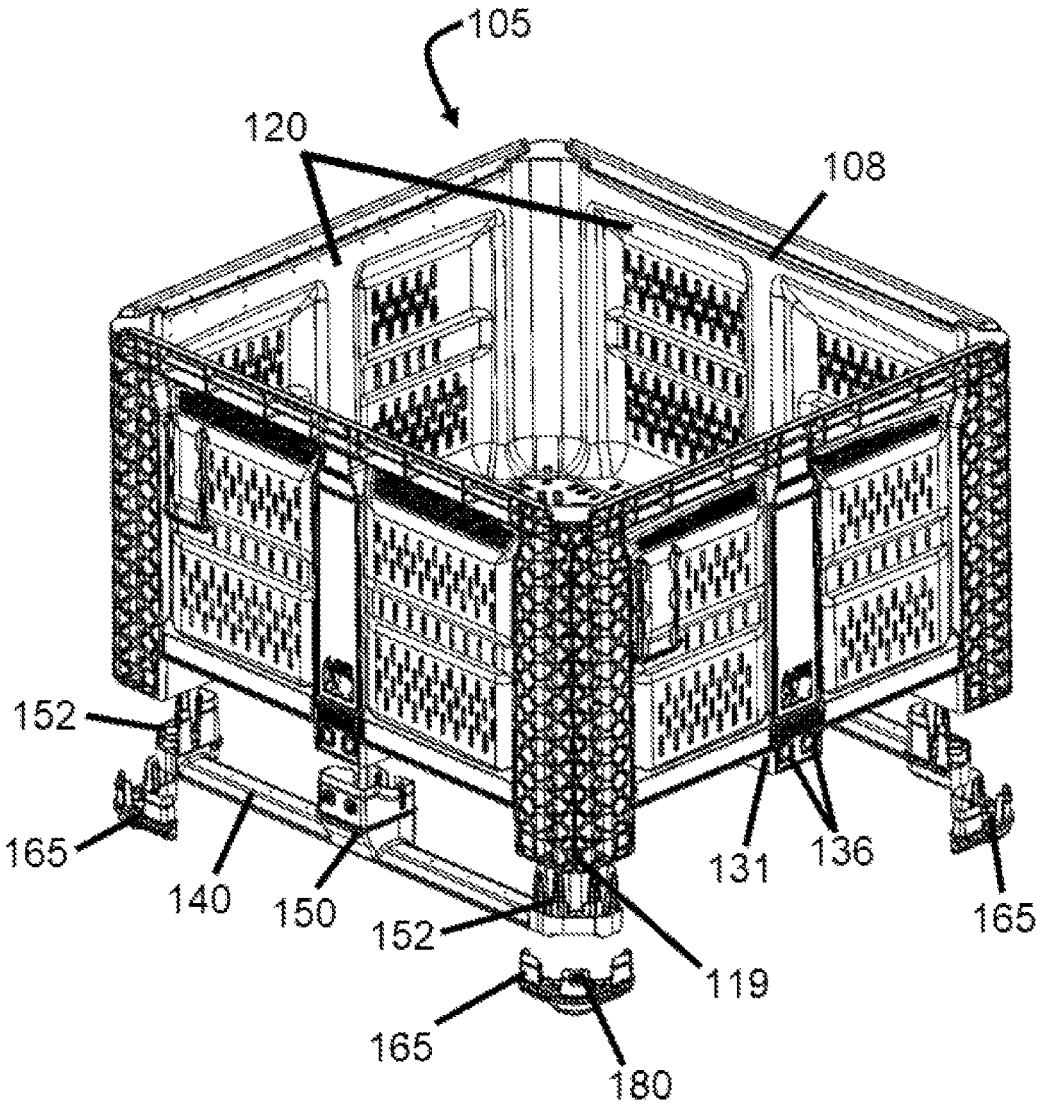
FIG. 8 is a top, exploded, and perspective view of a shipping container comprising a basket, a pair of feet, and feet pads, according to multiple embodiments and alternatives.
Figure 9:
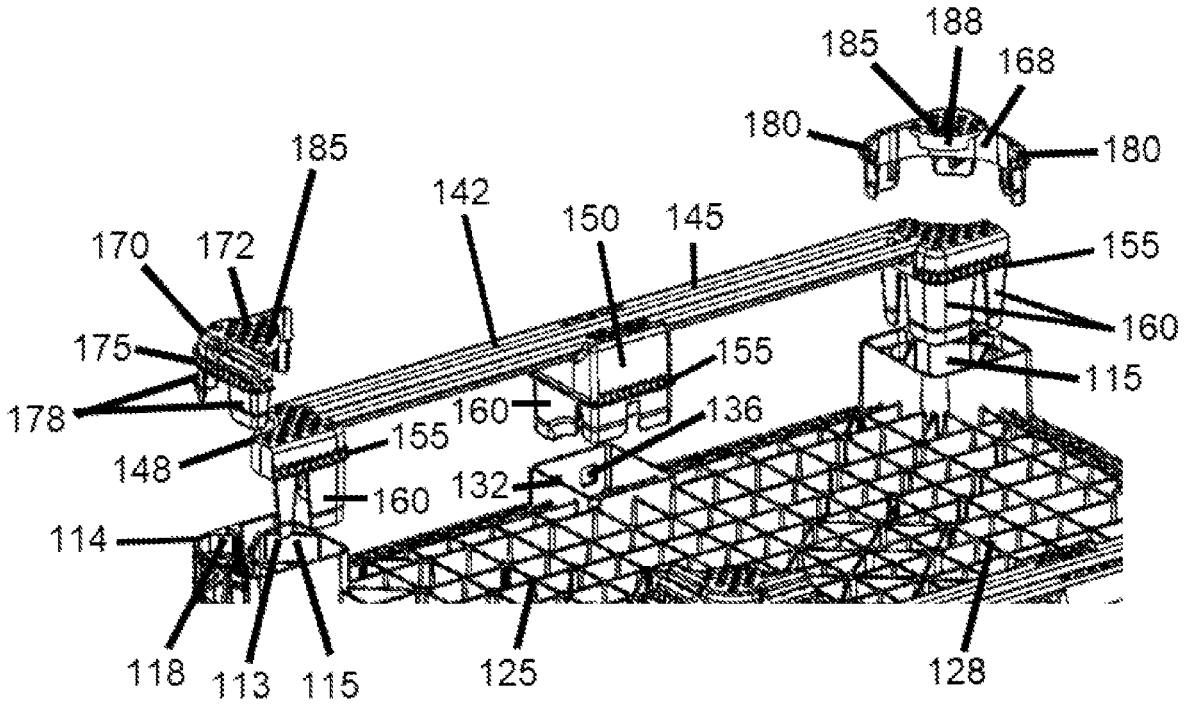
FIG. 9 is a close up view of the bottom of a basket, a foot, and feet pads, according to multiple embodiments and alternatives.

FIGS. 7-10 illustrate exploded views of shipping container 105 which consists of basket 108, a pair of feet 138, and a plurality of foot pads 165. Basket 108 consists of sidewalls 120, and corner columns 110 which are permanently attached to basket 108 (i.e. not removable). The corner columns 110 define an external face. The bottom of the corner columns 110 define a bottom edge 114, and a bottom opening 112. In some embodiments, internal support members 113 span the inside of the corner columns 110. As shown in FIGS. 7 and 9, the bottom opening 112 further comprises a foot receiving bore 115 and a foot pad receiving bore 118, which are adapted to receive the end components 152 of the feet 138 and the foot pads 165, respectively. The external face of corner columns 110 also define a button receiving hole 119, located proximal to the bottom opening 112, that is adapted to receive the release button 182 of the foot pads 165.

The bottom surface 125 of basket 108 comprises a series of reinforcing cells 128 and a plurality of extensions 130 that extend towards the ground. The plurality of extensions 130 comprise sidewalls 131 which define both a bottom edge 132 and foot receiving bores 135 that are adapted to receive the middle component 150 of the feet 138. In some embodiments, the sidewalls 131 also define button openings 136 that are adapted to receive pull clips 158 (located on the middle component 150 of the feet 138).

Figure 10:
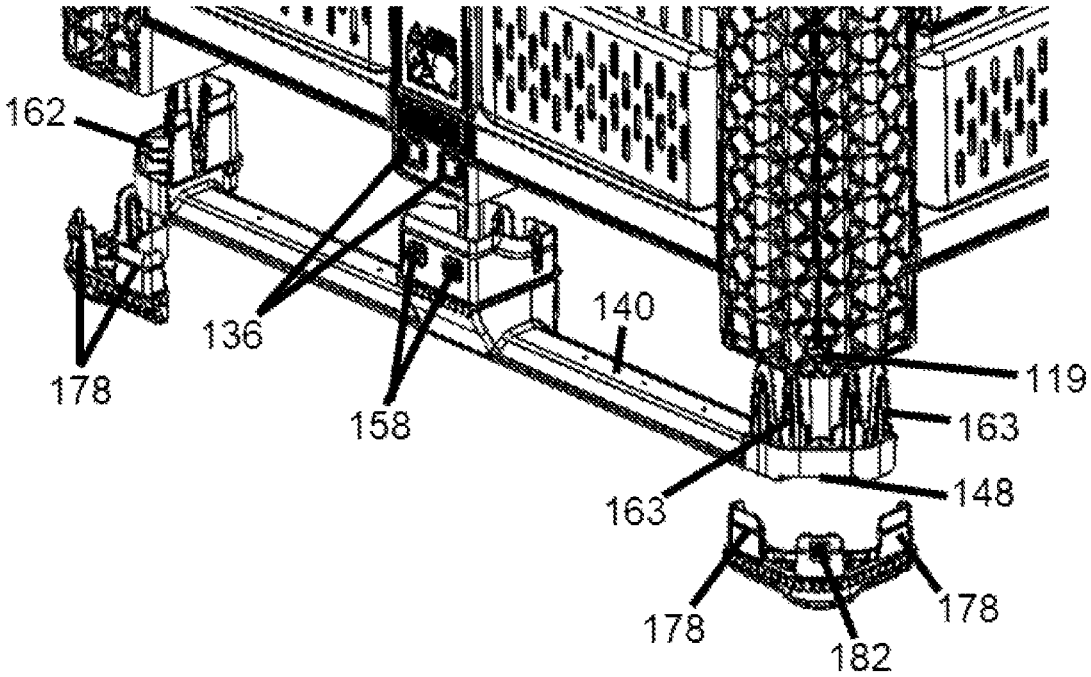
FIG. 10 is a close up view of a basket, a foot, and feet pads, according to multiple embodiments and alternatives.

The feet 138 consist of a top surface 140, a bottom surface 142, a middle component 150, and end components 152. As shown in FIG. 9, a groove 145 spans the length of the bottom surface 142 and provides additional support for the feet 138. Both the middle component 150 and the end components 152 comprise a shoulder 155 and a plurality of tabs 160 that are hingeably connected to and extend upward from shoulder 155. As best illustrated in FIG. 10, in some embodiments the tabs 160 of the middle component 150 further comprise pull clips 158 and the tabs 160 of the end components 152 further include a plurality of barbs 163. When the feet 138 are inserted into the bottom opening 112 and the foot receiving bores 135, the tabs 160 hinge inward and then engage the basket 108 and the internal support members 113. Likewise, the pull clips 158 are secured to button openings 136. As shown in FIGS. 9-10, the end components 152 further define a notch 148 positioned above the bottom surface 142 that is adapted to receive the lip 185 and protrusion 188 of the foot pads 165. As shown in FIG. 10, the end components also include support ribs 162.

According to multiple embodiments and alternatives, the foot pads 165 comprise an internal side 168, an external side 170, a bottom surface 172 and wing members 180. A lip 185 with a protrusion 188 is positioned in between the wing members 180, and is adapted to engage and secure to the notch 148 of the feet 138. Likewise, the internal side 168 of the feed pads 165 is designed to mate with the end components 152 of the feet 138. Foot pads 165 further comprise tabs 178 which are hingeably connected to a shoulder 175. In some embodiments, the external side 170 of a tab 178 further includes a release button 182 that is adapted to be received in the button receiving hole 119 of the corner columns 110.

Figure 11:
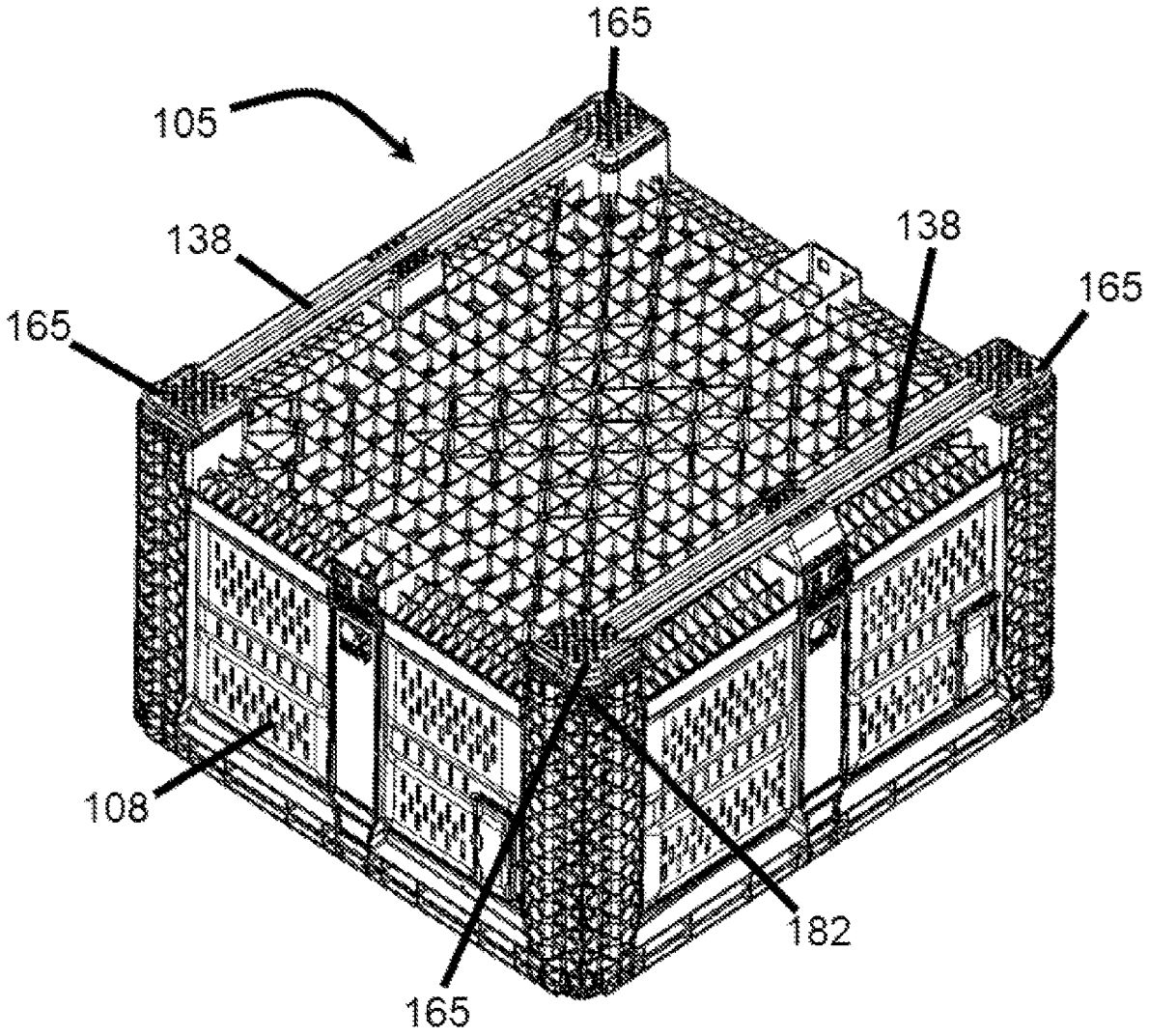
FIG. 11 is a bottom, perspective view of an assembled shipping container, according to multiple embodiments and alternatives.
Figure 12:
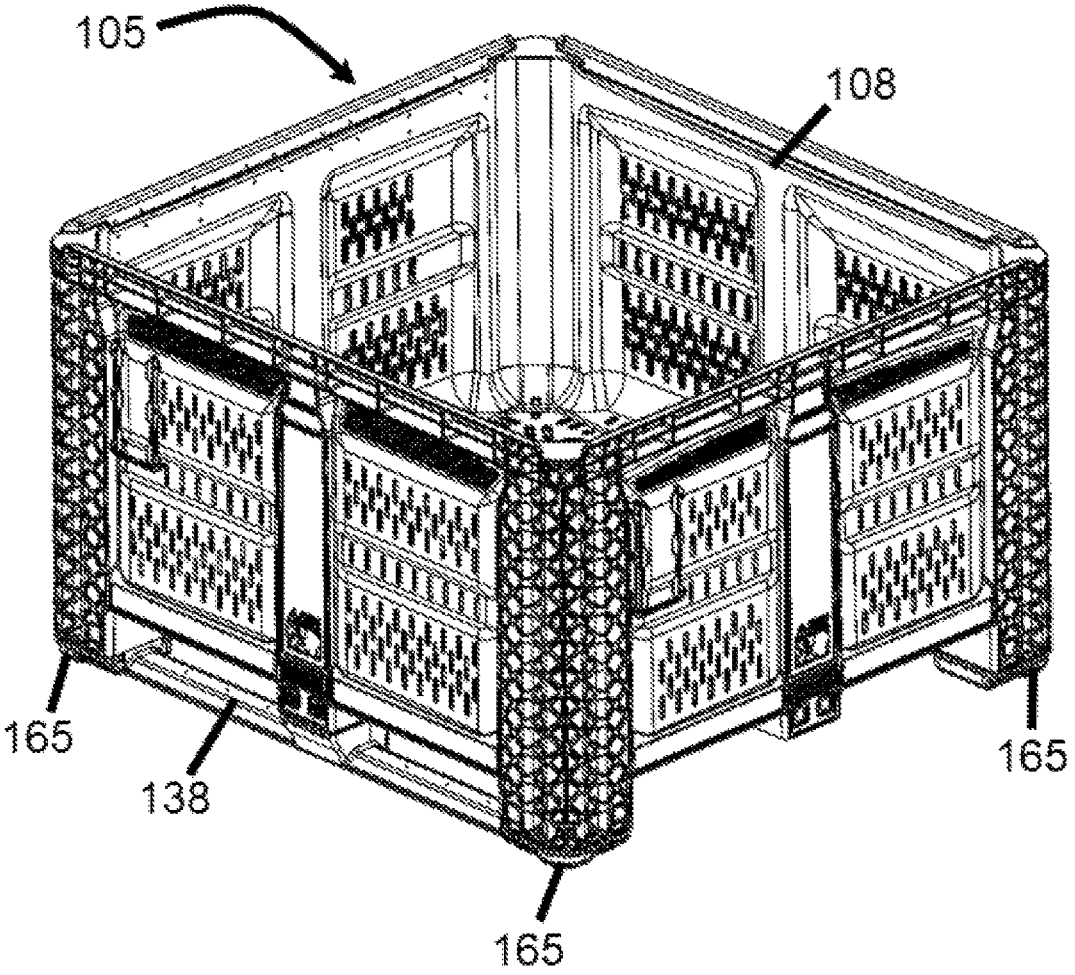
FIG. 12 is a top, perspective view of an assembled shipping container, according to multiple embodiments and alternatives.
Figure 13:
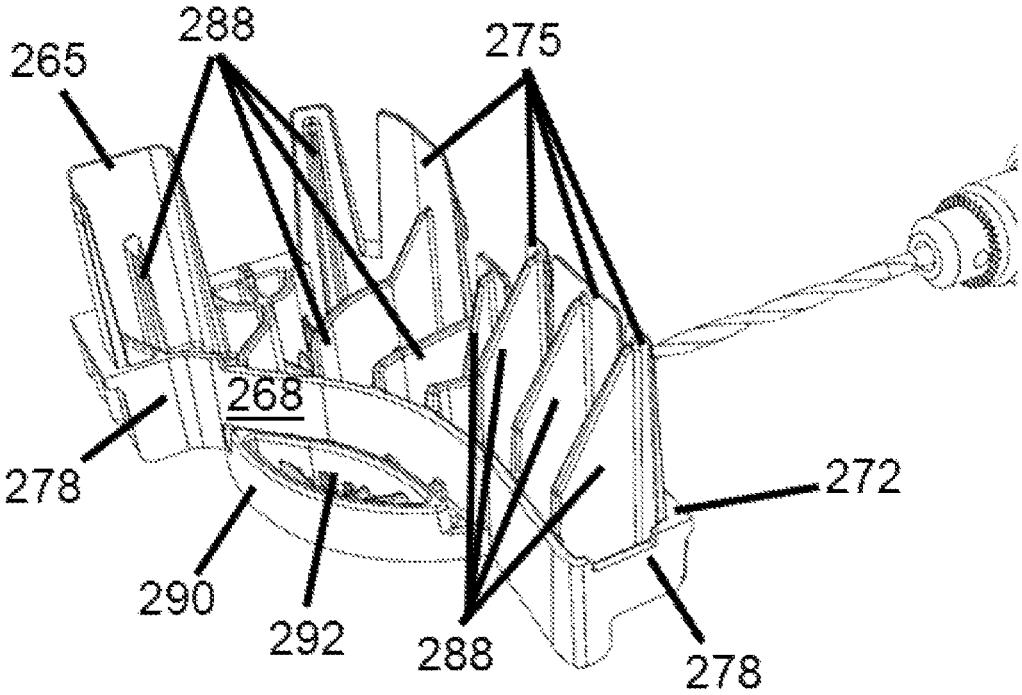
FIG. 13 is a perspective view of a foot pad with a drill release lock, according to multiple embodiments and alternatives.
Figure 14:
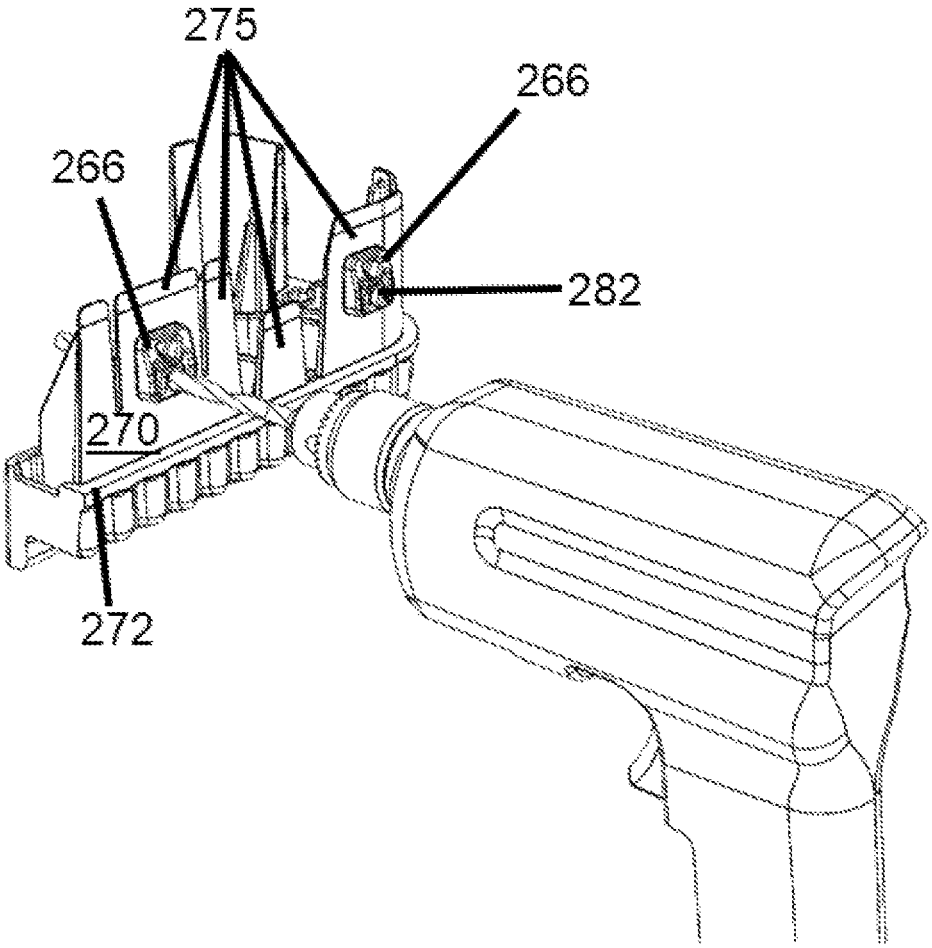
FIG. 14 is a perspective view of a foot pad with a drill release lock, according to multiple embodiments and alternatives.

FIGS. 11 and 12 illustrate the assembled shipping container 105. According to multiple embodiments and alternatives, the release button 182 of the foot pads 165 and the engagement between the protrusion 188 and the notch 148 securely attach both the feet 138 and the foot pads 165 to the basket 108.

In operation, to assemble shipping container 105 a user first positions basket 108 such that bottom surface 125 is facing upwards (as shown in FIG. 11). A user then inserts the middle component 150 of feet 138 into extension 130 until shoulder 155 engages the bottom edge 132 and pull clip 158 is received within button opening 136. Likewise, a user inserts the end components 152 of the feet 138 into foot receiving bores 115 until shoulder 155 engages the bottom edge 114. Next, a user attaches the foot pads 165 by inserting the tabs 178 into foot pad receiving bore 118 until shoulder 175 engages the bottom edge 114 and release button 182 is received within button receiving hole 119. A user can quickly disassemble shipping container 105 by pressing inward on release button 182 and pulling foot pads 165 out of the basket 108 (e.g. pulling the foot pads 165 shown in FIG. 11 upwards). The user can then pull the feet 138 out of basket 108 by applying a force necessary to overcome the interaction between the pull clips 158 and button opening 136. For instance, in FIG. 11 the feet 138 could be pulled upward to remove the feet 138 from the basket 108.

FIGS. 13-16 illustrate foot pad 265 with a drill release lock 266. According to multiple embodiments and alternatives, the foot pad 265 consists of an internal side 268, an external side 270, wing members 278, a shoulder 272, a plurality of tabs 275 that are hingeably connected to the shoulder 272, and back support ribs 288 which are connected to the internal side 268 of the tabs 275. Foot pad 265 further comprises a lip 290 located in between wing members 278 and extending inwardly from the internal side 268. A protrusion 292 extends downward from the lip 290. As shown most clearly in FIGS. 13 and 17, protrusion 292 and lip 290 are adapted to be received in notch 248 of foot 238.

Figure 15:
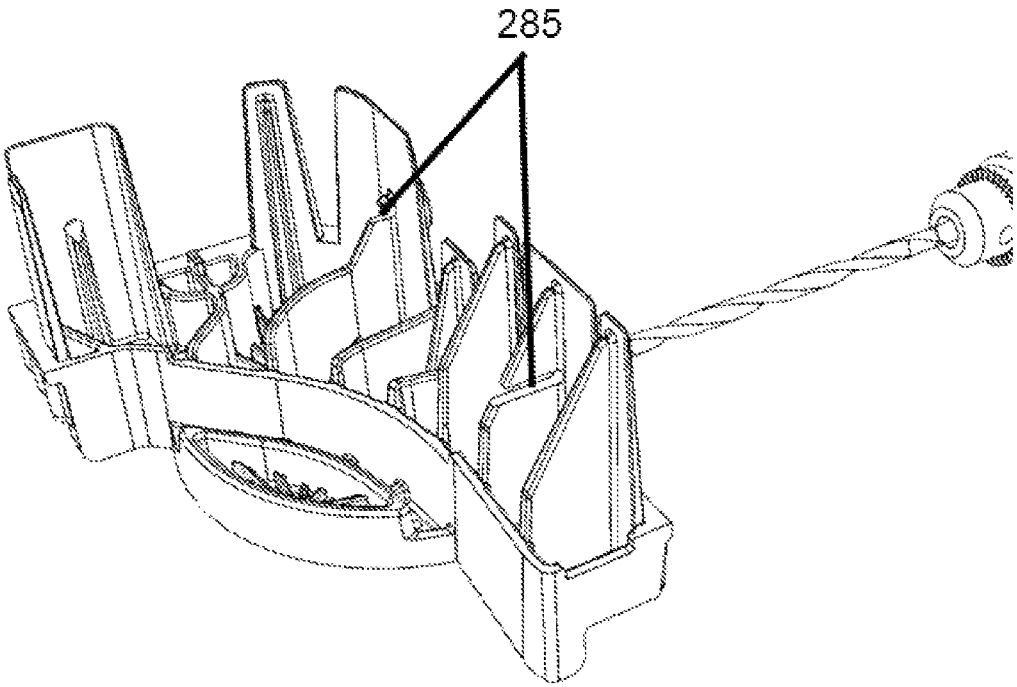
FIG. 15 is a perspective view of a foot pad with a drill release lock following engagement with a drill, according to multiple embodiments and alternatives.
Figure 16:
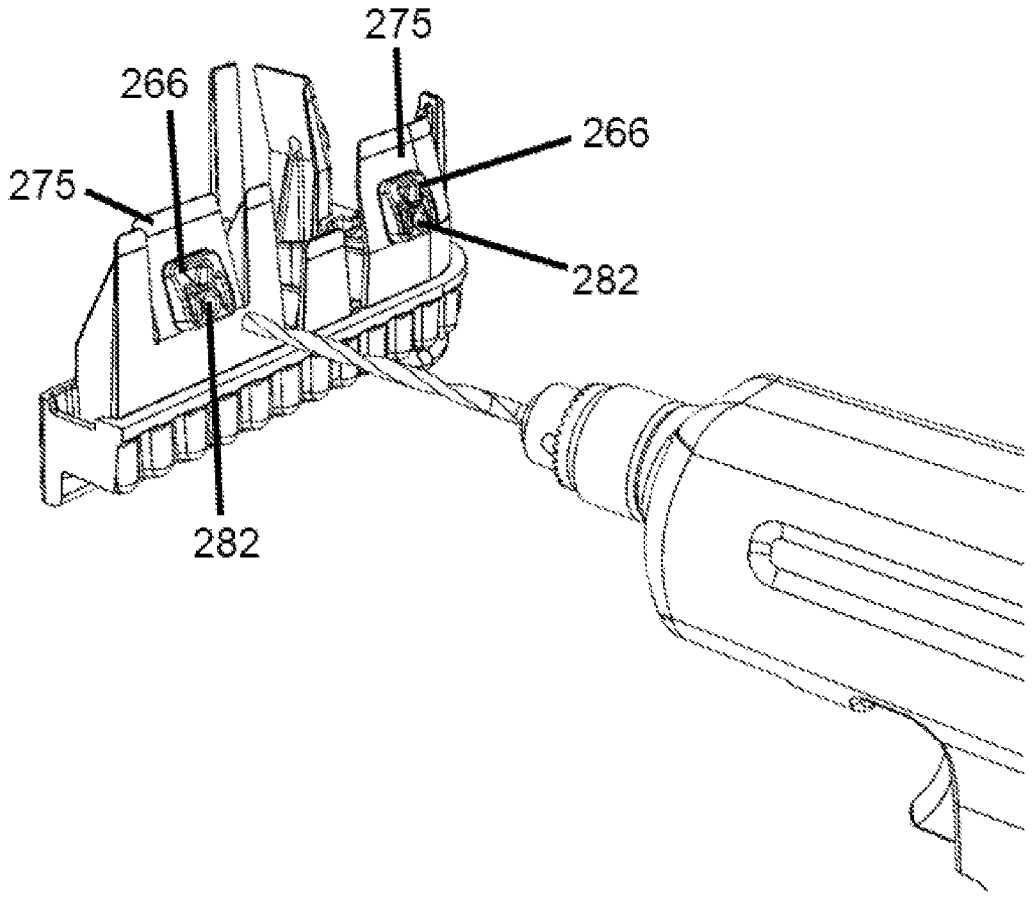
FIG. 16 is a perspective view of a foot pad with a drill release lock following engagement with a drill, according to multiple embodiments and alternatives.

In some embodiments, drill release lock 266 is attached to the external side 270 of tabs 275. The drill release lock 266 includes a pilot hole 282 which aligns with the back support rib 288. As shown in FIG. 15, upon insertion of a drill (as a non-limiting example) into the pilot hole 282, the drill splits the back support rib 288 and creates a bore 285. Upon creation of the bore 285 in the back support rib 288, the tabs 275 with a drill release lock 266 can easily hinge (as shown in FIG. 16) thereby providing a more secure and efficient connection to basket 208.

Figure 17:
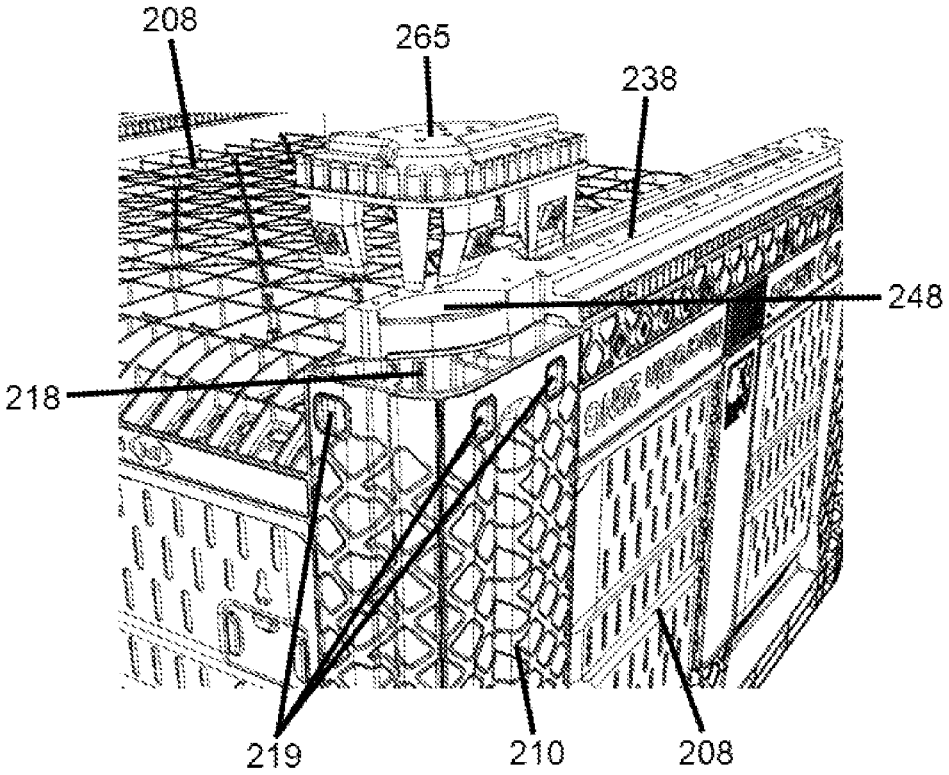
FIG. 17 is a perspective view of a foot pad and a basket, according to multiple embodiments and alternatives.
Figure 18:
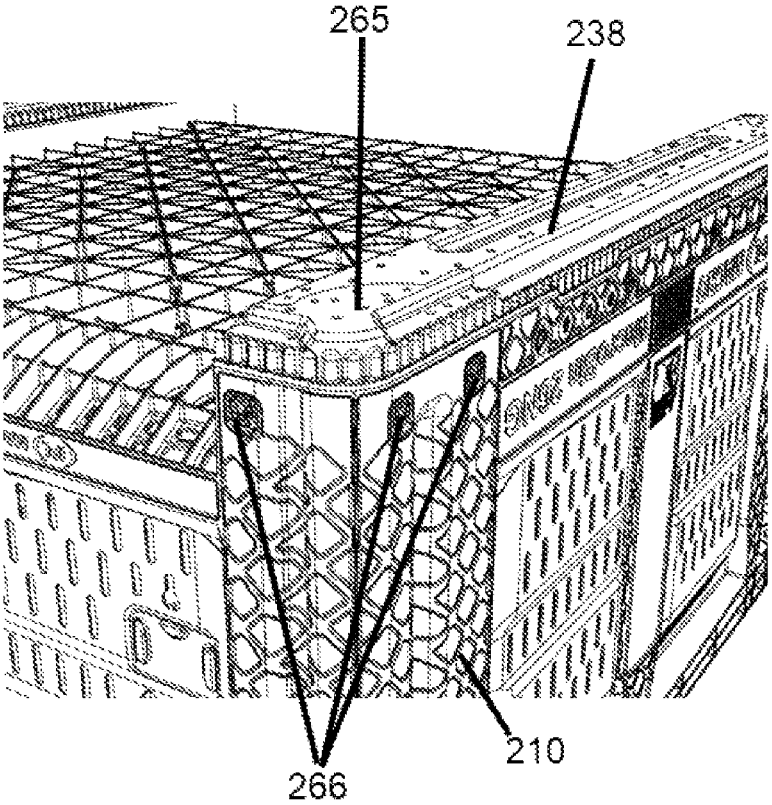
FIG. 18 is a perspective view of a foot pad and a basket, according to multiple embodiments and alternatives.

FIGS. 17-23 illustrate foot pad 265, basket 208, and foot 238. As best illustrated in FIG. 17, the corner column 210 of basket 208 defines a foot pad receiving bore 218 which is adapted to receive foot pad 265. The corner column 210 also defines a plurality of button receiving holes 219 which are adapted to receive the drill release locks 266 of foot pad 265. In FIGS. 17-23, foot 238 is connected to basket 208 as described herein. Foot 238 defines notch 248 which is adapted to receive lip 290 and protrusion 292 of foot pad 265.

Figure 19:
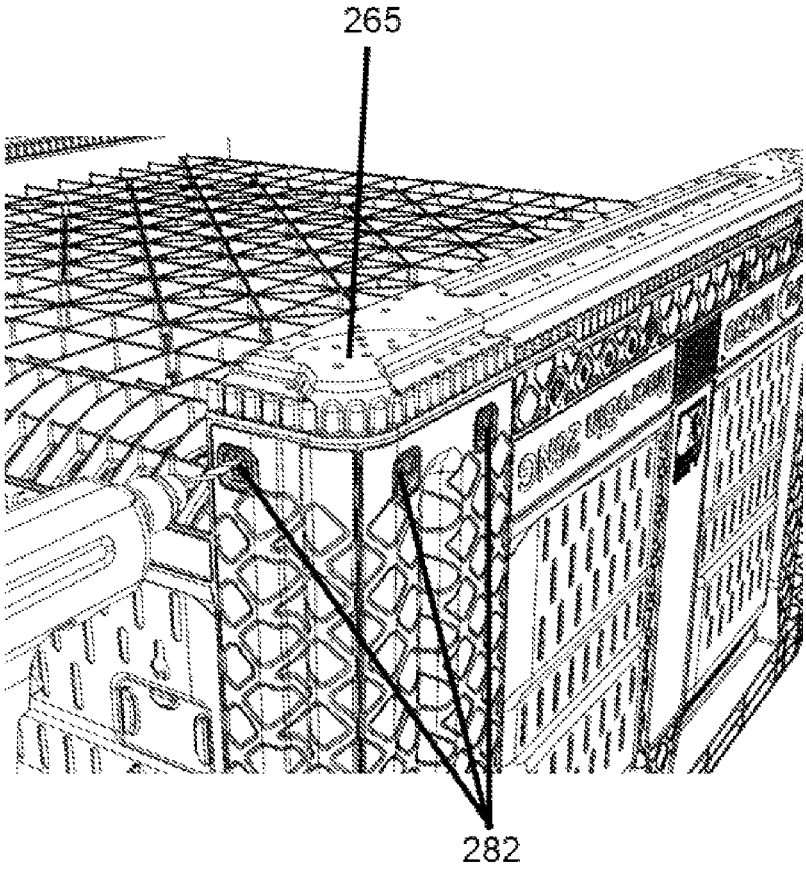
FIG. 19 is a perspective view of a foot pad and a basket, according to multiple embodiments and alternatives.
Figure 20:
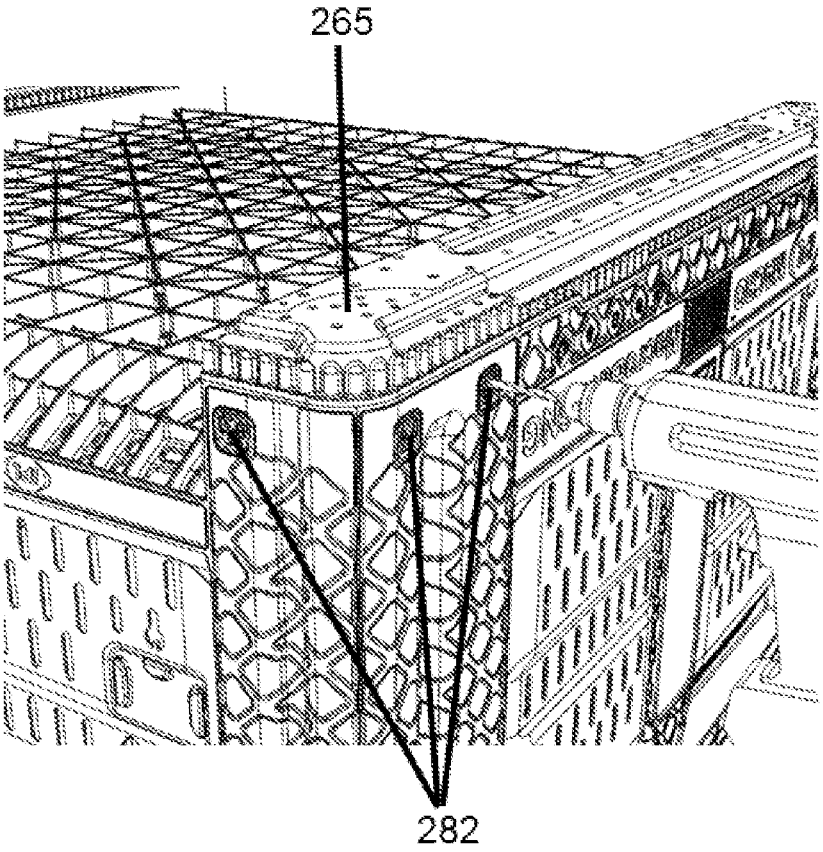
FIG. 20 is a perspective view of a foot pad and a basket, according to multiple embodiments and alternatives.
Figure 21:
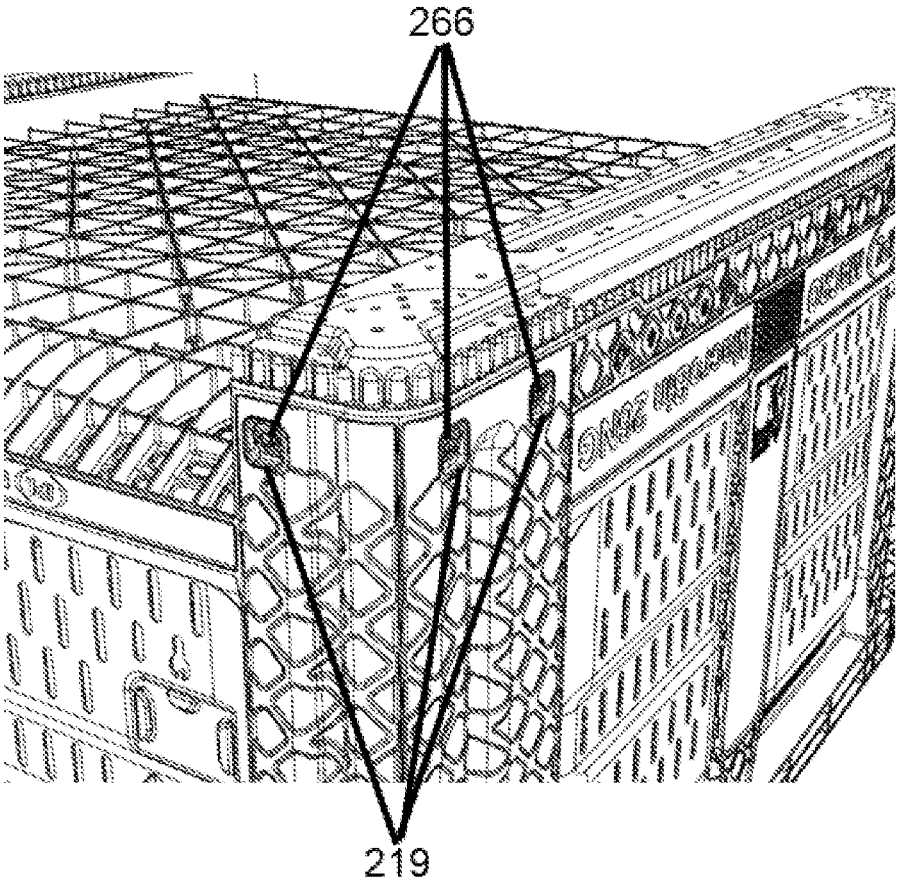
FIG. 21 is a perspective view of a foot pad and a basket following engagement with a drill, according to multiple embodiments and alternatives.
Figure 22:
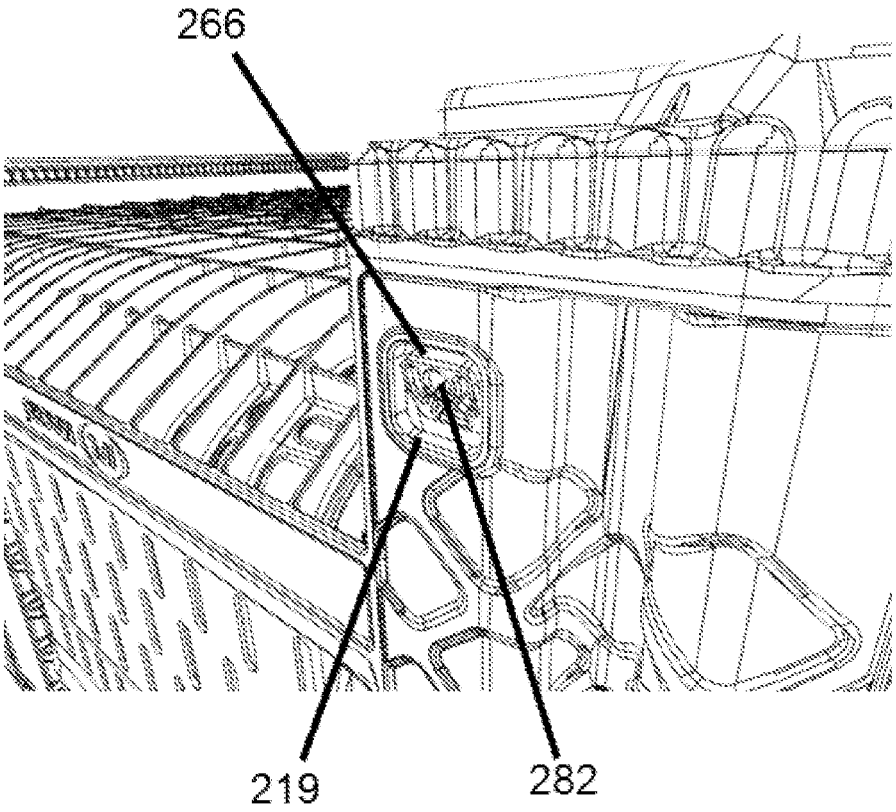
FIG. 22 is a close up view of a foot pad and a basket following engagement with a drill, according to multiple embodiments and alternatives.
Figure 23:
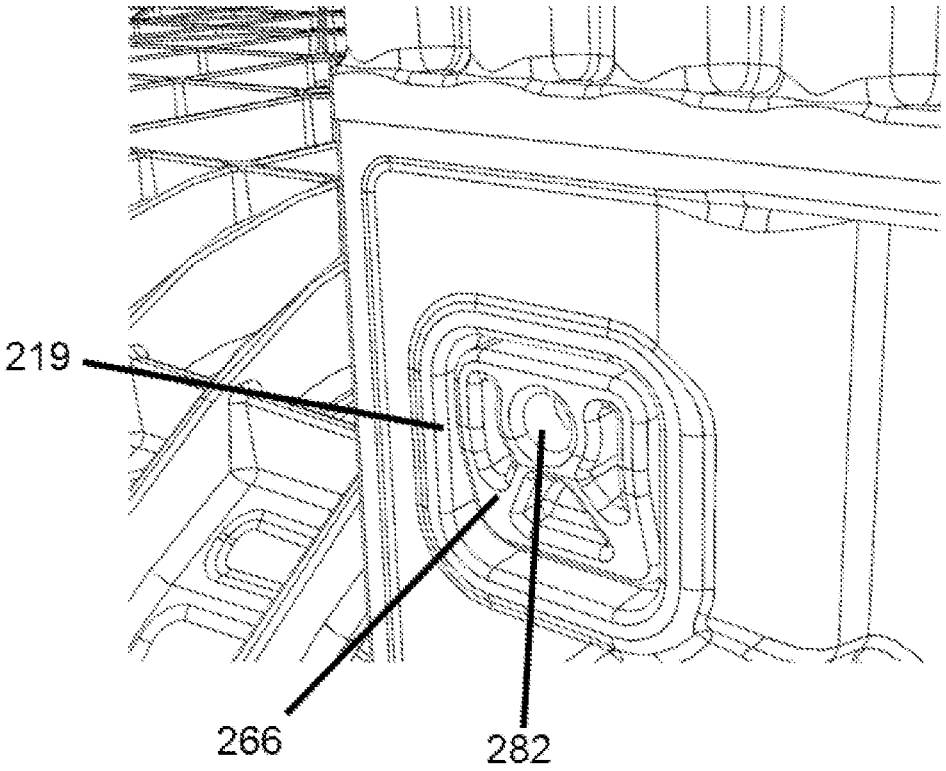
FIG. 23 is a close up view of a foot pad and a basket following engagement with a drill, according to multiple embodiments and alternatives.

According to multiple embodiments and alternatives, a user may create bores 285 with a drill (as a non-limiting example) either before or after foot pad 265 is received in foot pad receiving bore 218. For instance, as shown in FIG. 17, the bores 285 have been created by a user prior to placement in the foot pad receiving bore 218. FIGS. 18-23 illustrate creation of bores 285 after foot pad 265 is received in both foot pad receiving bore 218 and notch 248 of foot 238. Likewise, the plurality of drill release locks 266 engage the button receiving holes 219 of the corner column 210. Once the foot 265 is connected to basket 208 and foot 238, a user can insert a drill (as a non-limiting example) into the pilot holes 282, as shown in FIGS. 19 and 20. After creation of bores 285, the tabs 275 with a drill release lock 266 hinge inwardly thereby providing a more secure and efficient connection with the button receiving holes 219 of the corner column 210. FIGS. 22 and 23 illustrate close up views of a drill release lock 266 in which bore 285 has been created, thereby permitting tabs 275 to hinge inwardly and creating a more secure engagement between drill release lock 266 and button receiving hole 219.

Figure 24:
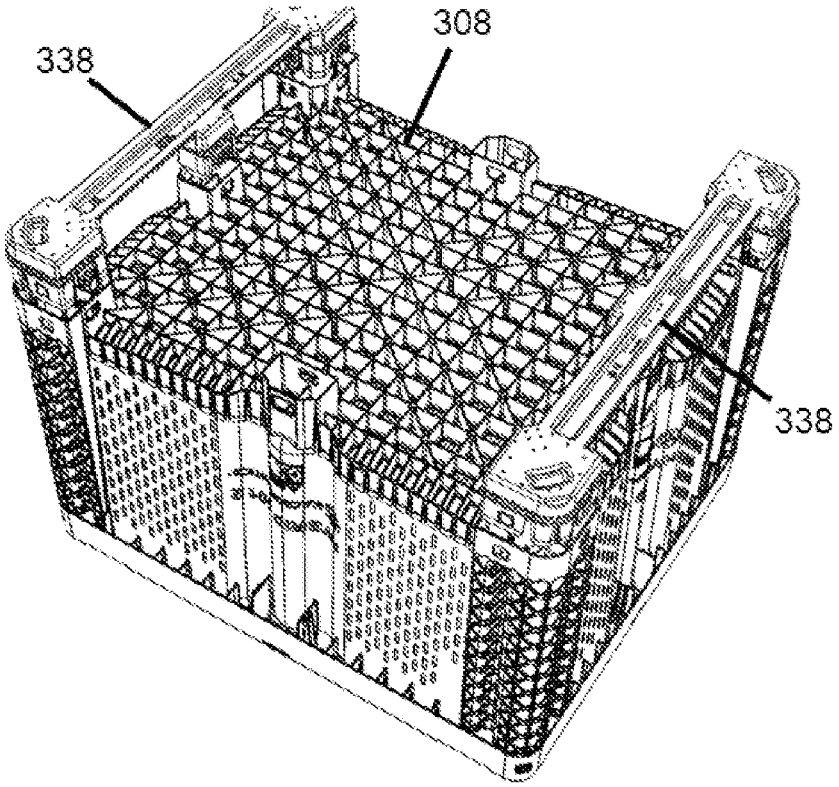
FIG. 24 is a bottom, exploded view of a shipping container comprising a basket and a pair of feet, according to multiple embodiments and alternatives.
Figure 25:
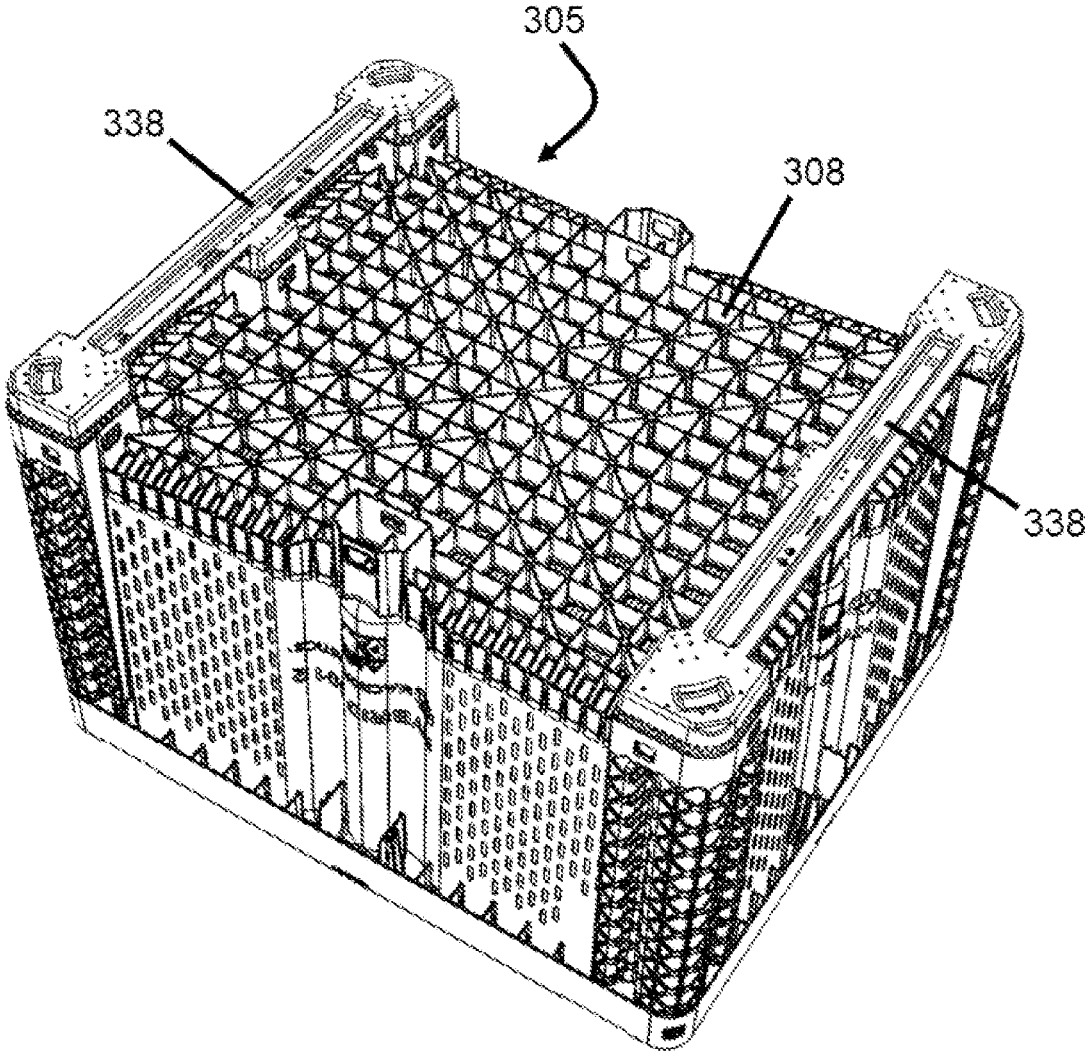
FIG. 25 is a bottom view of an assembled shipping container comprising a basket and a pair of feet, according to multiple embodiments and alternatives.

According to multiple embodiments and alternatives, FIGS. 24-25 illustrate a shipping container 305 comprising a basket 308 and a pair of feet 338 (which span the entire bottom length of basket 308). It will be appreciated by one of ordinary skill in the art that any number of components described herein may be selected as needed by a user including but limited to feet 338, feet 138, feet 38, corner column 65, foot pads 165, foot pads 265, and combinations thereof.

Figure 28:
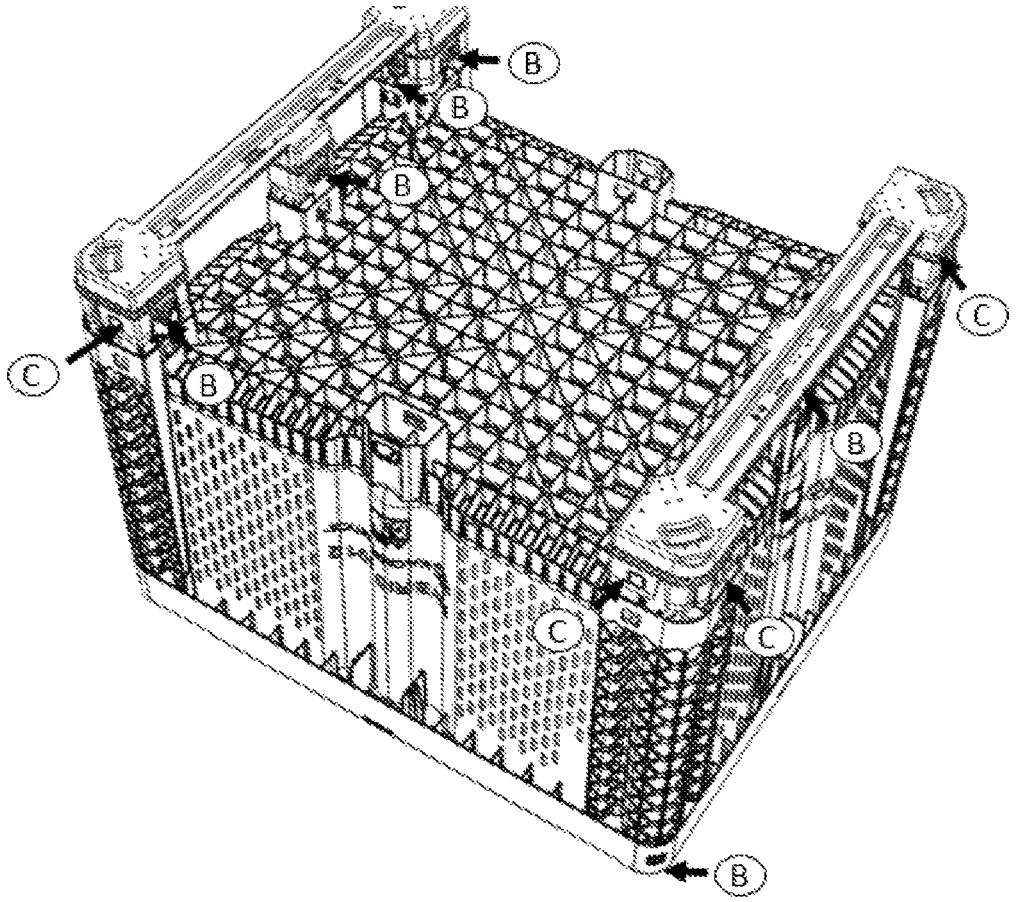
FIG. 28 is a bottom, exploded view of a shipping container comprising a basket and a pair of feet, according to multiple embodiments and alternatives.
Figure 29:
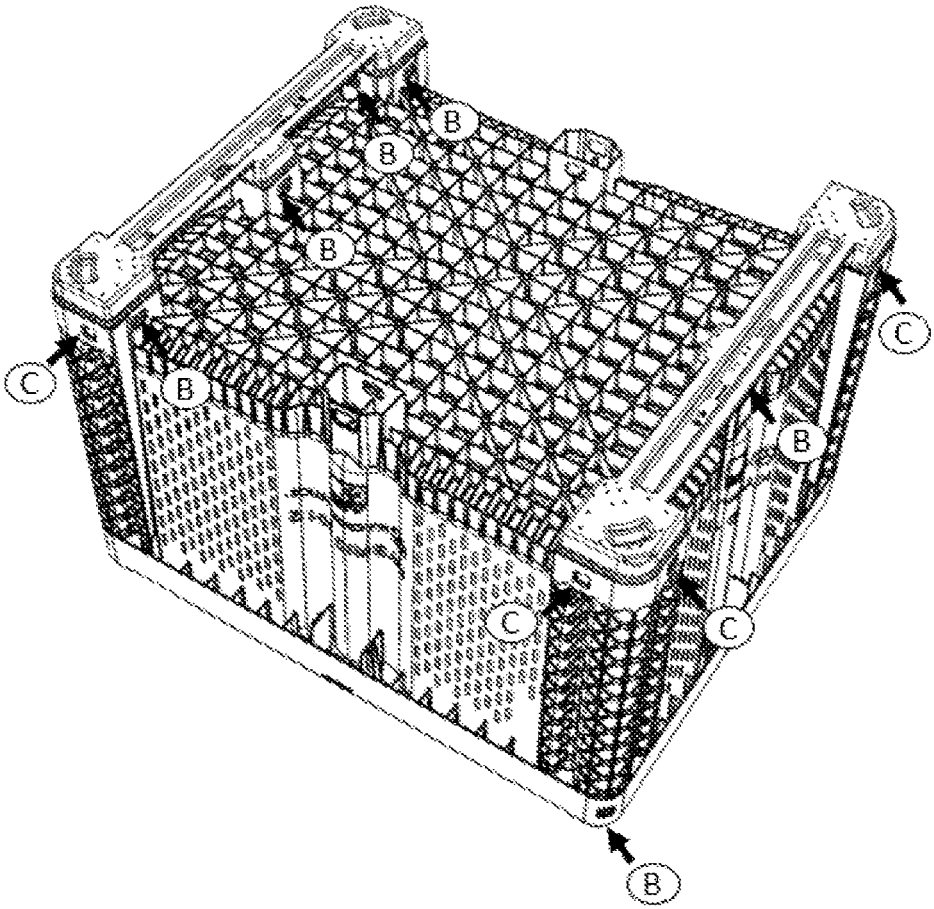
FIG. 29 is a bottom view of an assembled shipping container comprising a basket and a pair of feet, according to multiple embodiments and alternatives.
Figure 30:
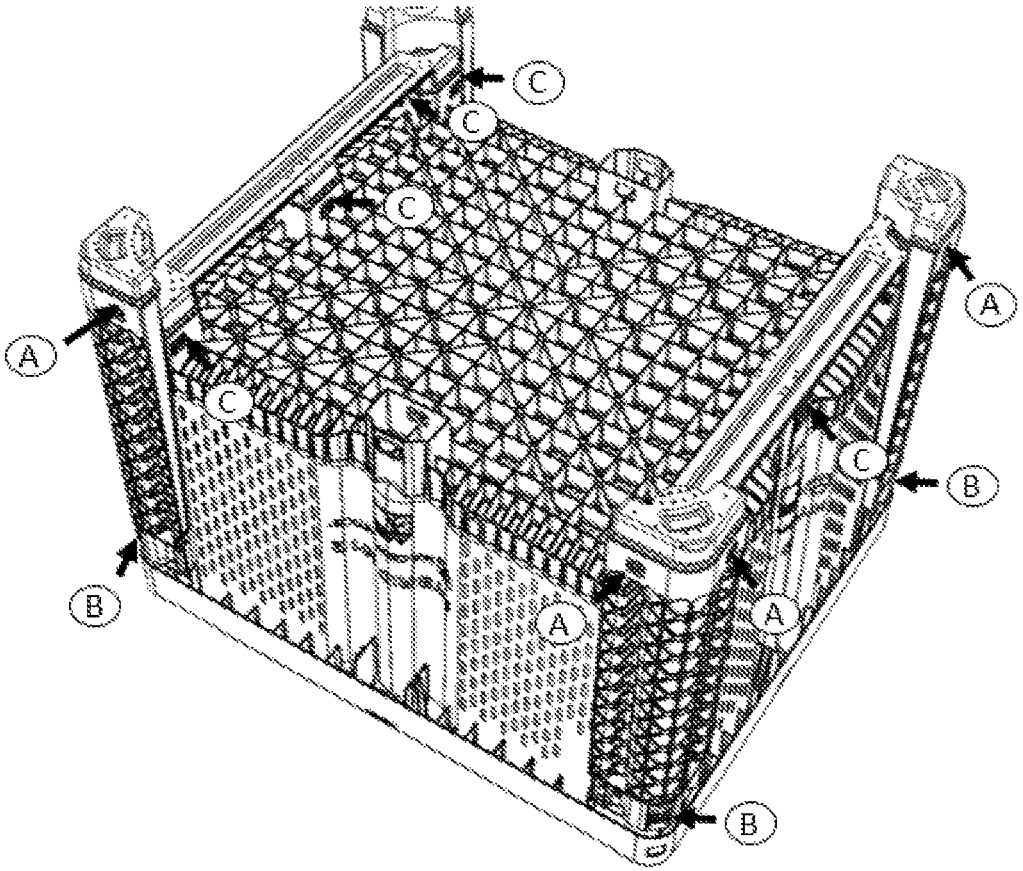
FIG. 30 is a bottom view of a shipping container comprising a basket, a pair of feet, and corner columns, according to multiple embodiments and alternatives.
Figure 31:
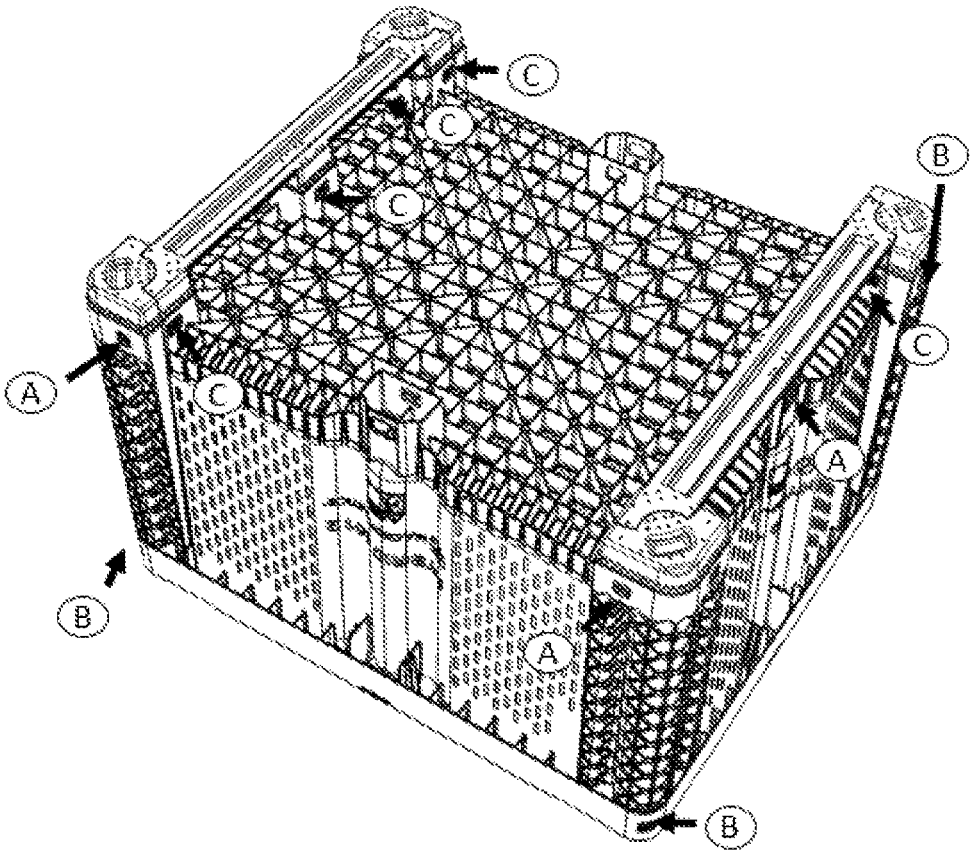
FIG. 31 is a bottom view of an assembled shipping container comprising a basket, a pair of feet, and corner columns, according to multiple embodiments and alternatives.

It will also be appreciated by one of ordinary skill in the art that any number of component interconnections may be selected as needed by a user. FIGS. 26-29 illustrate a variety of component interactions for shipping container 305, and FIGS. 30-31 illustrate a variety of component interactions for shipping container 5. In FIGS. 26-31, the letter "A" refers to a locked button (e.g. locked button 98), the letter "B" refers to a release button (e.g. release button 80), and the letter "C" refers to a pull clip (e.g. pull clip 58), as non-limiting examples.

Figure 26:
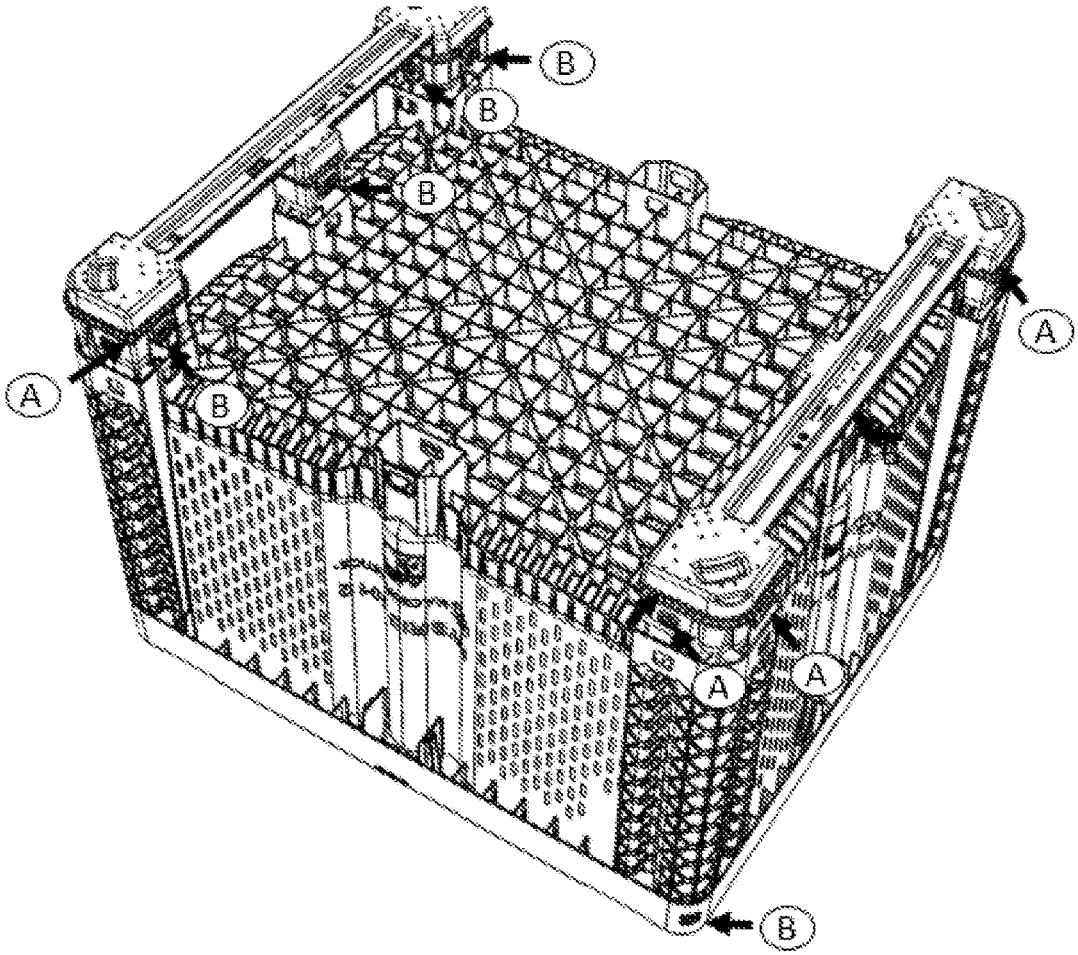
FIG. 26 is a bottom, exploded view of a shipping container comprising a basket and a pair of feet, according to multiple embodiments and alternatives.
Figure 27:
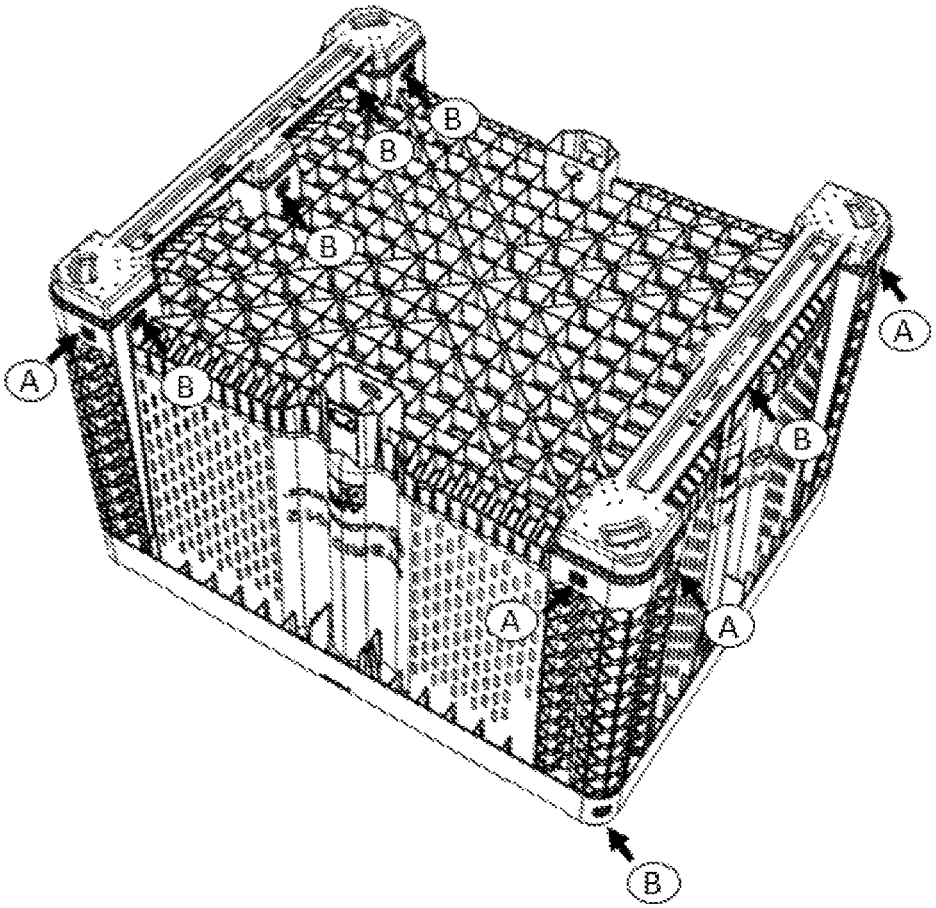
FIG. 27 is a bottom view of an assembled shipping container comprising a basket and a pair of feet, according to multiple embodiments and alternatives.

According to multiple embodiments and alternatives, a user may desire to utilize the shipping container for harvesting agricultural products in a long growing season (i.e. a "harvest" arrangement). As such, the user can select the more permanent connections consisting of locked buttons and release buttons as shown in FIGS. 26-27. If a user desires to disassemble the shipping container in the winter (referred to as a "knock down" arrangement), the user may select interconnections comprising press release buttons and pull clips that can be more easily disassembled, as shown in FIGS. 28-29. Likewise, a desire may wish to easily transport the container for returnable shipping and storage. As such, a user may select a shipping container 5 with removable corner columns 65 and feet 38 interconnected by locked buttons, press release buttons, and pull clips, as shown in FIGS. 30-31.

It will be understood that the embodiments described herein are not limited in their application to the details of the teachings and descriptions set forth, or as illustrated in the accompanying figures. Rather, it will be understood that the present embodiments and alternatives, as described and claimed herein, are capable of being practiced or carried out in various ways.

Also, it is to be understood that words and phrases used herein are for the purpose of description and should not be regarded as limiting. The use herein of "including," "comprising," "e.g.," "containing," or "having" and variations of those words is meant to encompass the items listed thereafter, and equivalents of those, as well as additional items.

Accordingly, the foregoing descriptions of several embodiments and alternatives are meant to illustrate, rather than to serve as limits on the scope of what has been disclosed herein. The descriptions herein are not intended to be exhaustive, nor are they meant to limit the understanding of the embodiments to the precise forms disclosed. It will be understood by those having ordinary skill in the art that modifications and variations of these embodiments are reasonably possible in light of the above teachings and descriptions.

What is claimed is:

1. A foot pad, comprising:

an internal side, an external side, a first wing member and an opposing second wing member, a shoulder, and a plurality of tabs extending upwardly from said shoulder;

wherein at least one of said plurality of tabs is hingeably connected to said shoulder.

2. The foot pad of claim 1, wherein a plurality of back support ribs are integrally connected to an internal side of each of the plurality of tabs.

3. The foot pad of claim 2, wherein a drill release lock is defined on an external side of at least one tab.

4. The foot pad of claim 3, wherein the drill release lock defines a pilot hole positioned in alignment with the back support rib integrally connected to the internal side of said tab.

5. The food pad of claim 4, wherein a bore can be defined through said tab and said back support rib using a drill passed through said pilot hole.

6. The foot pad of claim 1, further comprising a lip positioned between the first and second wing members.

7. The foot pad of claim 6, wherein said lip extends outwardly from the internal side of the foot pad, said lip further comprising a top surface and said top surface defines a protrusion which extends upward.

8. A foot pad, comprising:

an internal side, an external side, a first wing member and an opposing second wing member, a shoulder, and a plurality of tabs extending upwardly from said shoulder;

wherein at least one of said plurality of tabs is hingeably connected to said shoulder;

wherein a plurality of back support ribs are integrally connected to an internal side of each of the plurality of tabs; and wherein a drill release lock is defined on an external side of the at least one tab being hingeably connected to the shoulder.

9. The foot pad of claim 8, further comprising a lip positioned between the first and second wing members, said lip extending outwardly from the internal side of the foot pad.

10. The foot pad of claim 9, wherein said lip further comprises a top surface and said top surface defines a protrusion which extends upward.

11. The foot pad of claim 8, wherein the drill release lock defines a pilot hole positioned in alignment with the back support rib integrally connected to the internal side of said tab;

wherein a bore can be defined through said tab and said back support rib using a drill passed through said pilot hole.

12. A shipping container, comprising:

a basket having a bottom surface and a plurality of corner columns;

at least one foot adapted to be received in the bottom surface of the basket; and at least one foot pad comprising an internal side, an external side, a first wing member and an opposing second wing member, a shoulder, and a plurality of tabs extending upwardly from said shoulder;

wherein at least one of said plurality of tabs is hingeably connected to said shoulder.

13. The shipping container of claim 12, wherein the bottom surface of each of said plurality of corner columns defines a foot pad receiving bore being adapted to receive the at least one foot pad.

14. The shipping container of claim 13, wherein a plurality of back support ribs are integrally connected to an internal side of each of the plurality of tabs;

wherein a drill release lock is defined on an external side of the at least one tab that is hingeably connected to the shoulder; and wherein the drill release lock defines a pilot hole positioned in alignment with the back support rib integrally connected to the internal side of said tab.

15. The shipping container of claim 14, wherein each of said corner columns further defines at least one button receiving hole, wherein said at least one button receiving hole is adapted to receive said drill release lock of the at least one food pad.

16. The shipping container of claim 13, wherein the at least one food pad further comprises a lip positioned between the first and second wing members, wherein said lip extends outwardly from the internal side of the foot pad.

17. The shipping container of claim 16, wherein the at least one foot comprises a pair of opposing ends, wherein a bottom surface of each opposing end defines a notch being adapted to receive the lip of said foot pad.

18. The shipping container of claim 17, wherein said lip further comprises a top surface and said top surface defines a protrusion which extends upward;

wherein the notch of each opposing end of the at least one foot is further adapted to receive both the lip and the protrusion of said foot pad.

19. The shipping container of claim 18, wherein the at least one foot pad is adapted to secure the at least one foot to the bottom surface of the basket.

20. The shipping container of claim 19, wherein the at least one foot pad and the at least one foot are adapted to form a flat surface upon engagement with the bottom surface of the basket.

* * * * *